US012487048B2

(12) United States Patent
Crowell et al.

(10) Patent No.: US 12,487,048 B2
(45) Date of Patent: Dec. 2, 2025

(54) ARCHERY ARROW REST CORD TENSIONING SYSTEM

(71) Applicant: Bowtech, LLC, Eugene, OR (US)

(72) Inventors: Trevor Crowell, Brownsville, OR (US); Jacob Jurasevich, Eugene, OR (US); Kyle Egerdee, Fergus (CA); Cole Jessup, Cambridge (CA)

(73) Assignee: BOWTECH, LLC, Eugene, OR (US)

( * ) Notice: Subject to any disclaimer, the term of this patent is extended or adjusted under 35 U.S.C. 154(b) by 156 days.

(21) Appl. No.: 18/409,667

(22) Filed: Jan. 10, 2024

(65) Prior Publication Data

US 2025/0224194 A1 Jul. 10, 2025

(51) Int. Cl.
*F41B 5/14* (2006.01)

(52) U.S. Cl.
CPC ..... *F41B 5/143* (2013.01)

(58) Field of Classification Search
CPC ..... F41B 5/143
USPC ..... 124/24.1
See application file for complete search history.

(56) References Cited

U.S. PATENT DOCUMENTS

| | | | | |
|---|---|---|---|---|
| 3,342,173 | A | 9/1967 | Ferguson | |
| 4,287,868 | A | 9/1981 | Schiff | |
| 4,344,409 | A | 8/1982 | Barner | |
| 4,473,058 | A | 9/1984 | Terry | |
| 4,489,704 | A | 12/1984 | Troncoso, Jr. | |
| 4,548,189 | A | 10/1985 | Pietraszek et al. | |
| 4,676,220 | A | 6/1987 | Pietraszek | |
| 4,803,971 | A | 2/1989 | Fletcher | |
| 4,865,007 | A | 9/1989 | Saunders | |
| 4,907,566 | A | 3/1990 | Klein | |
| 4,953,521 | A | 9/1990 | Troncoso et al. | |
| 5,150,700 | A | 9/1992 | Troncoso | |
| 5,179,930 | A | 1/1993 | Simo | |
| 5,235,958 | A | 8/1993 | Laffin | |
| 5,490,491 | A * | 2/1996 | Troncoso | F41B 5/143 124/44.5 |
| 5,503,136 | A | 4/1996 | Tone | |
| 5,601,069 | A | 2/1997 | Clark | |
| 5,634,455 | A | 6/1997 | Troncoso | |
| D384,723 | S | 10/1997 | Jessee | |
| 5,673,678 | A | 10/1997 | Savage | |

(Continued)

OTHER PUBLICATIONS

Dakota Archery Products, Inc., Dakota Confidence 7 Arrow Holders (4-page color brochure, mostly burgundy border, 4-page, front & back on 11×17 glossy paper)), date unknown, Madison, South Dakota.

(Continued)

*Primary Examiner* — John E Simms, Jr.
(74) *Attorney, Agent, or Firm* — Husch Blackwell LLP

(57) ABSTRACT

A fall away arrow rest system for use with an archery bow. The arrow rest system includes a launcher that is adapted to support a shaft of an arrow prior to firing the arrow. Upon firing the arrow, the launcher rotates from an upright position to a lowered position to move out of the way by the time the tail region of the arrow passes by the launcher. The arrow rest system includes a rest cord coupled to the arrow rest, the effective length and tension of which determines the timing of the launcher rotating out of the way. The arrow rest system includes a system for adjusting the effective length of and tension in the rest cord to adjust the timing as desired.

19 Claims, 26 Drawing Sheets

(56) References Cited

U.S. PATENT DOCUMENTS

| | | | | |
|---|---|---|---|---|
| 5,678,530 | A | 10/1997 | Van Drielen | |
| 5,685,287 | A | 11/1997 | Greywall | |
| 5,722,381 | A | 3/1998 | Mizek | |
| 5,743,245 | A | 4/1998 | Mizek | |
| 5,746,192 | A * | 5/1998 | Gissel | F41B 5/14 254/223 |
| D396,519 | S | 7/1998 | Jessee | |
| D397,402 | S | 8/1998 | Jessee | |
| 5,855,200 | A | 1/1999 | Jessee | |
| 5,896,849 | A | 4/1999 | Branthwaite et al. | |
| 5,915,369 | A | 6/1999 | Sheliga | |
| 5,944,005 | A | 8/1999 | Schiff | |
| 5,950,610 | A | 9/1999 | Troncoso | |
| 5,960,779 | A | 10/1999 | Jessee et al. | |
| 5,992,402 | A | 11/1999 | Vyprachticky | |
| 6,021,769 | A | 2/2000 | Troncoso | |
| 6,039,036 | A | 3/2000 | Padilla | |
| 6,044,832 | A | 4/2000 | Piersons, Jr. | |
| 6,050,251 | A | 4/2000 | Harwath et al. | |
| 6,082,348 | A | 7/2000 | Savage | |
| 6,089,216 | A | 7/2000 | Harwath et al. | |
| 6,102,020 | A | 8/2000 | Mizek et al. | |
| 6,142,134 | A | 11/2000 | Meeks | |
| 6,178,959 | B1 | 1/2001 | Troncoso, Jr. et al. | |
| 6,202,635 | B1 | 3/2001 | Evans | |
| 6,276,352 | B1 | 8/2001 | Harris et al. | |
| 6,363,924 | B1 | 4/2002 | Adams, Jr. | |
| RE38,096 | E | 4/2003 | Branthwaite et al. | |
| 6,561,174 | B1 | 5/2003 | Afshari | |
| 6,561,175 | B1 | 5/2003 | Tidmore | |
| 6,595,195 | B1 | 7/2003 | Barner et al. | |
| 6,615,813 | B1 | 9/2003 | Troncoso, Jr. et al. | |
| 6,634,349 | B2 | 10/2003 | Mizek et al. | |
| 6,637,419 | B1 | 10/2003 | Troncoso, Jr. et al. | |
| 6,662,796 | B2 | 12/2003 | St. Cyr | |
| 6,679,241 | B2 | 1/2004 | Proctor | |
| 6,681,753 | B2 | 1/2004 | Afshari | |
| 6,681,754 | B1 | 1/2004 | Angeloni | |
| 6,684,871 | B1 | 2/2004 | Troncoso et al. | |
| 6,688,296 | B1 | 2/2004 | Greywall | |
| 6,688,297 | B1 | 2/2004 | Clague | |
| 6,725,851 | B1 | 4/2004 | Graf | |
| 6,739,321 | B1 | 5/2004 | Puchlerz | |
| 6,742,510 | B2 | 6/2004 | Troncoso, Jr. | |
| 6,742,511 | B1 | 6/2004 | Remme | |
| 6,772,747 | B1 | 8/2004 | Vastag | |
| 6,776,149 | B1 | 8/2004 | Beeks | |
| 6,782,881 | B2 | 8/2004 | Mizek et al. | |
| 6,789,535 | B1 | 9/2004 | Mcintyre | |
| 6,789,536 | B1 | 9/2004 | Summers | |
| 6,792,932 | B2 | 9/2004 | Musacchia, Jr. | |
| 6,820,607 | B1 | 11/2004 | Terry | |
| 6,823,856 | B2 | 11/2004 | Rager | |
| 7,331,338 | B2 | 2/2008 | Mizek | |
| 7,409,950 | B2 | 8/2008 | Ellig et al. | |
| 7,597,095 | B2 | 10/2009 | Grace, Jr. et al. | |
| 7,963,279 | B2 | 6/2011 | Harwath et al. | |
| 7,980,237 | B1 | 7/2011 | Rasor et al. | |
| 8,434,464 | B1 | 5/2013 | Terzo | |
| 8,474,443 | B2 | 7/2013 | Geno | |
| 8,544,457 | B1 | 10/2013 | Munsell et al. | |
| 8,596,253 | B2 | 12/2013 | Adams | |
| 8,701,643 | B2 | 4/2014 | Ellig | |
| 8,752,536 | B2 | 6/2014 | Sims et al. | |
| 8,960,174 | B2 | 2/2015 | Khoshnood | |
| 9,151,567 | B1 | 10/2015 | Estridge | |
| 9,341,433 | B1 * | 5/2016 | Summers | F41B 5/143 |
| 9,816,776 | B2 | 11/2017 | Ellig et al. | |
| 2003/0024516 | A1 * | 2/2003 | Mizek | F41B 5/143 124/44.5 |
| 2004/0139953 | A1 | 7/2004 | Harwath et al. | |
| 2006/0157038 | A1 * | 7/2006 | Ellig | F41B 5/143 124/44.5 |
| 2007/0163560 | A1 | 7/2007 | Mertens | |
| 2007/0221186 | A1 | 9/2007 | Grace et al. | |
| 2008/0216807 | A1 * | 9/2008 | Troncoso | F41B 5/143 124/88 |
| 2008/0236556 | A1 | 10/2008 | Sims et al. | |
| 2009/0101127 | A1 | 4/2009 | Johnson | |
| 2011/0139137 | A1 | 6/2011 | Simo et al. | |
| 2011/0139138 | A1 | 6/2011 | Geno | |
| 2012/0138035 | A1 | 6/2012 | Ellig | |
| 2013/0139798 | A1 * | 6/2013 | Khoshnood | F41B 5/143 124/44.5 |
| 2013/0255654 | A1 * | 10/2013 | Nystrom | F41B 5/143 124/44.5 |
| 2015/0184972 | A1 | 7/2015 | Grace et al. | |
| 2016/0341512 | A1 | 11/2016 | Grace, Jr. | |
| 2017/0003096 | A1 * | 1/2017 | Ellig | F41B 5/143 |
| 2017/0191788 | A1 * | 7/2017 | Eacker | F41B 5/10 |
| 2018/0058798 | A1 * | 3/2018 | Coalson | F41B 5/143 |
| 2020/0116452 | A1 | 4/2020 | Wilson et al. | |
| 2022/0397370 | A1 | 12/2022 | Munsell et al. | |
| 2023/0272995 | A1 | 8/2023 | Munsell et al. | |
| 2024/0240909 | A1 * | 7/2024 | Pauley | F41B 5/105 |

OTHER PUBLICATIONS

Hunter's Friend the Bowhunter's Pro-Shop, QAD Ultra-Rest Drop Away Arrow Rest (Internet advertisement printout (black & white, 4 pages)), date unknown, location unknown.

Quality Archery Designs, Ultra-Rest The Ultimate Drop-Away Rest (Internet advertisement printout (black & white, 8 pages)), date unknown, Madison Heights, Virginia.

Ripcord Arrow Rest, Fall-Away Arrow Rest (color brochure (mostly brown and white with black lettering, 2-page, front and back, 8.5×11 glossy paper)), date unknown, Dillon, Montana.

Ripcord Fall-Away Rest, Fall-Away Rest (color insert (mostly blue w/ white clouds, 2-page, front & back on 6.5×4.5 glossy paper with rounded corners)), date unknown, Dillon, Montana.

* cited by examiner

ARCHERY ARROW REST CORD TENSIONING SYSTEM

CROSS-REFERENCE TO RELATED APPLICATIONS

None.

BACKGROUND OF THE INVENTION

The present invention is directed generally to an archery bow and a fall away arrow rest system for incorporation therewith.

Arrow rests for bows provide a user with a steady surface on which the user can place the shaft of an arrow as the user prepares to aim and fire the arrow at a target. More specifically, arrow rests allow the user to make aiming adjustments based on the surrounding environmental conditions (e.g., wind speed and direction) while reducing the tendency of dropping of the arrow.

One common problem with arrow rests is that the fletching of the arrow, which is necessary for stable arrow flight, may contact the arrow rest when the arrow is fired, thereby changing the desired trajectory and flight path of the arrow. "Drop away" or "fall away" arrow rests have been developed to reduce the tendency of the fletching contacting the arrow rest when the arrow is fired. Drop away arrow rests, such as those described and shown in U.S. Pat. Nos. 7,409,950, 8,701,643, and 9,816,776, normally include a support element or launcher arm designed to quickly rotate out of the way as an arrow is fired. The intent is that the launcher arm will be completely out of the way by the time the tail region of the arrow, where the fletching is located, passes by the launcher. In order to achieve this rapid rotation, the launcher arm can be biased to drop away as soon as the bowstring is initially released to fire an arrow. The biased drop away motion can be triggered by the release of an arrow rest cord connected to a portion of the bow, such as a bow cable, such that release of the bow string changes the tension in the arrow rest cord to allow rotation of the biased launcher arm.

However, such arrow rests are not without deficiencies. Primarily, the timing of the launcher arm movement is determined by the tension in the arrow rest cord when the bow is at full draw. Setting the tension of the cord typically requires specialized tools and expertise, and testing the associated timing is typically done by guess and check, which can lead to an overall time-consuming and cumbersome process. Additionally, the tension can change due to knots slipping or cords, cables, and/or strings stretching over time. A change in tension can also be caused by changing environmental conditions, so setting the timing in a shop or indoor environment can still result in sub-optimal timing when used outdoors or in differing environmental conditions. Sub-optimal launcher arm timing can have an adverse impact on a user by altering the desired trajectory and flight path of the arrow.

Accordingly, a need exists for a drop away arrow rest for an archery bow that can allow for minor adjustments to the tension and timing in the field. A further need also exists for a user to be able to make these adjustments in a timely manner.

BRIEF SUMMARY OF THE INVENTION

The present invention is directed generally to a fall away arrow rest system and a system for adjusting the cord tension and timing thereof. The launcher that the shaft of the arrow rests on is rotated downward and out of the way of the tail end of the shaft as soon as the arrow is fired. The timing of this rotation is determined by the tension or effective length of the cord connecting the arrow rest to a portion of the bow, such as a bow limb or a power cable. According to embodiments of the present invention, adjustments can be made to the effective length of, and/or tension in, the cord.

According to one embodiment, the arrow rest includes a housing adapted for mounting to a bow, a rotatable shaft supported by the housing, a launcher coupled to the rotatable shaft and configured to receive a shaft of an arrow, and a turn knob configured for receiving or coupling with a first end of a cord. The turn knob may be engaged and rotationally interlock with the rotatable shaft using a set screw. The arrow rest can further comprise a first element, such as a gear, coupled to the rotatable shaft and including, for example, gear teeth. It may also include a second element, such as a pawl or detent ball, configured to engage with the gear teeth. A biasing element, such as a spring, can bias the second element (e.g., pawl or detent ball) to engage the first element (e.g., gear or its teeth). Due to this structure and engagement, rotating the turn knob in a first direction about an axis of rotation can result in rotation of the turn knob about the rotatable shaft without transferring rotation to the rotatable shaft, wherein the first element and second element are permitted to skip or slide by each other when the turn knob is rotated in the first direction. Conversely, rotating the turn knob in a second direction about the axis of rotation opposite the first direction can result in the second element engaging the first element to transfer rotation of the turn knob to the rotatable shaft. The arrow rest may further include a push button configured to engage the biasing element, wherein when the push button is depressed the biasing element does not bias the second element to engage the first element.

The turn knob may include an aperture defined therein that is configured for receiving at least a portion of a first end of the cord. A set screw may be inserted into the turn knob and can be adapted for engaging and fixedly retaining the first end of the cord within the aperture when the set screw is tightened. A second end of the cord can be coupled to the bow. In one embodiment, the second end of the cord is coupled to a power cable of the bow. In another embodiment, the second end of the cord is coupled to a limb of the bow. In further embodiments, the second end of the cord may be coupled to other components of the bow. The cord can be configured such that tension in the cord can rotate the turn knob in the second direction.

The effective length of the cord and/or an amount of maximum tension in the cord when the bow is at draw or at brace can be adjusted by rotating the turn knob. For example, in one embodiment, an amount of maximum tension in the cord when the bow is at draw or at brace can be increased by rotating the turn knob in a first direction about the axis of rotation. Similarly, the amount of maximum tension in the cord can be decreased by rotating the turn knob in a second direction about the axis of rotation.

The rotatable shaft may be rotatably biased in the same direction of rotation as the first direction. In one embodiment, the rotatable shaft is biased in a direction that corresponds to biasing the launcher to an upward position, wherein rotating the turn knob in the second direction rotates the launcher to a downward position. In another embodiment, the rotatable shaft is biased in a direction that corresponds to biasing the launcher to a downward position, wherein rotating the turn knob in the second direction rotates the launcher to an upward position.

Objects and advantages pertaining to the mounting assembly for archery bows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
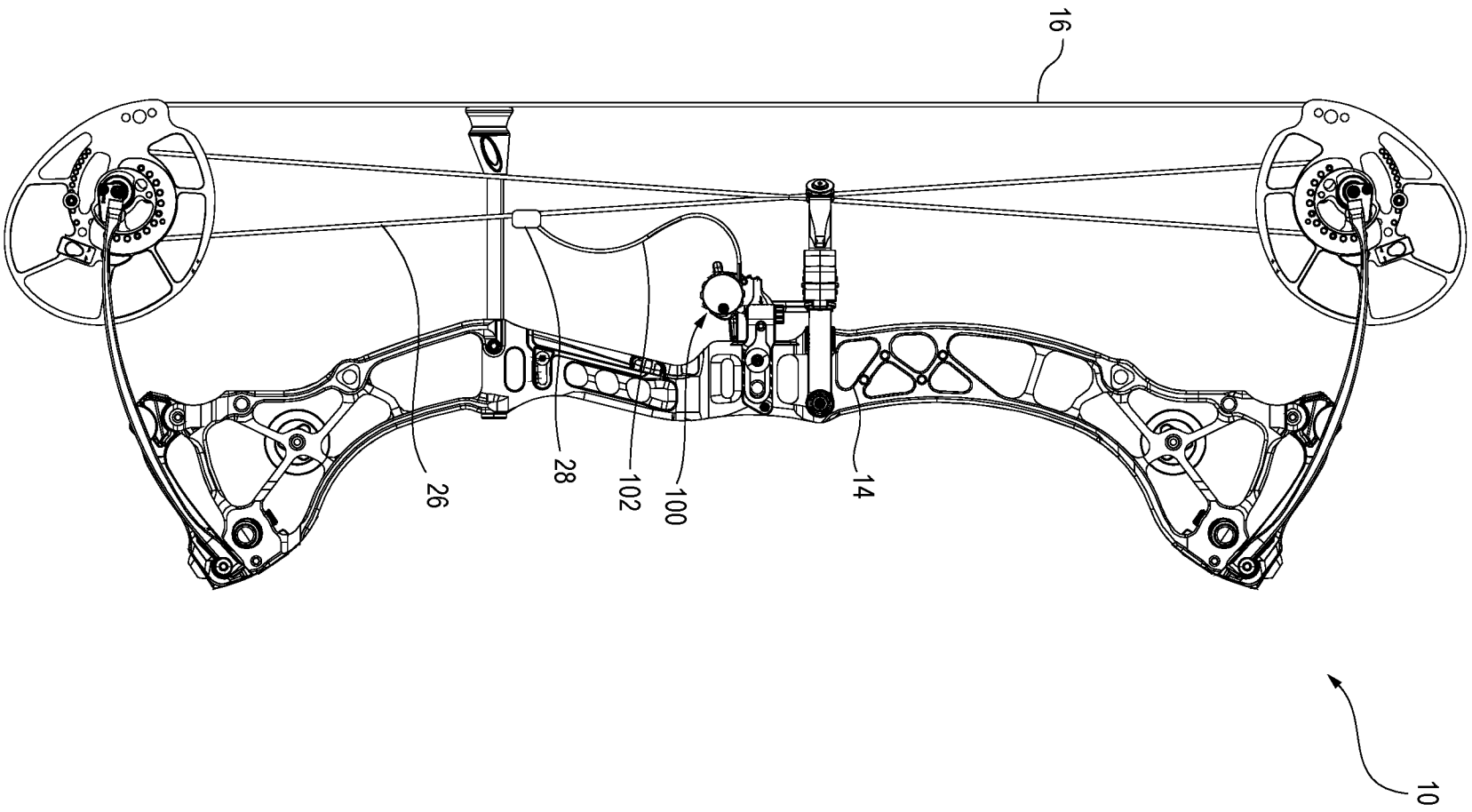
FIG. 1 is a schematic view of an archery bow with a cable driven arrow rest shown in the braced position.

Various embodiments of the present invention are described and shown in the accompanying materials, descriptions, instructions, and drawings. For purposes of clarity in illustrating the characteristics of the present invention, proportional relationships of the elements have not necessarily been maintained in the drawings. It will be understood that any dimensions included in the drawings are simply provided as examples and dimensions other than those provided therein are also within the scope of the invention.

The description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to an archery bow and a fall away arrow rest system for incorporation therewith. Specifically, the fall away arrow rest system can have its cord tension adjusted or tuned to set the timing of the fall away arrow rest system for different bow and/or arrow parameters or shooting conditions. As shown and described herein, the tension may be adjusted in the field, which allows a user to quickly set or readjust to a desired tension given the specific conditions experienced.

Figure 2:
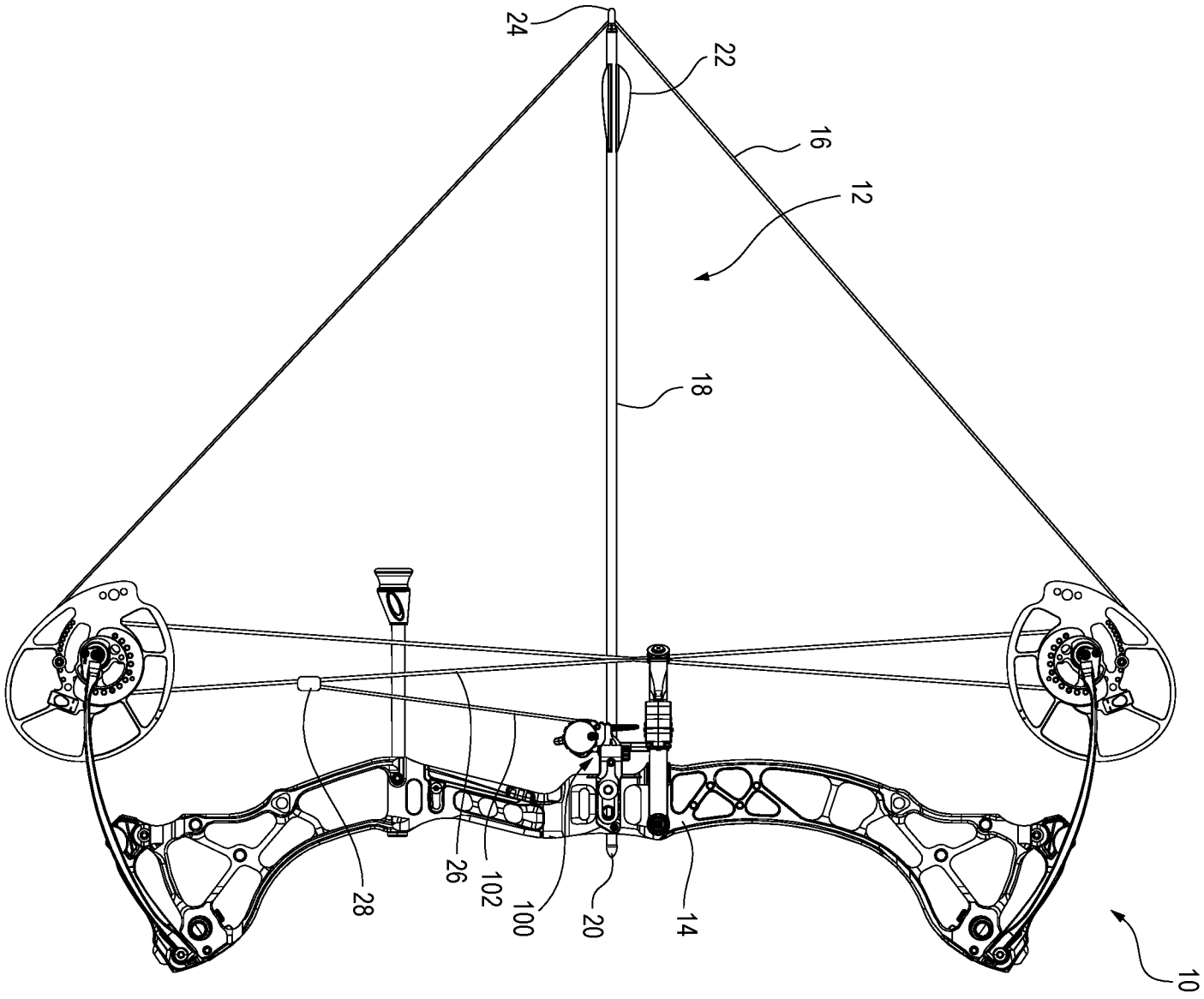
FIG. 2 is a schematic view of an archery bow with a cable driven arrow rest of FIG. 1 shown in the drawn position.
Figure 3:
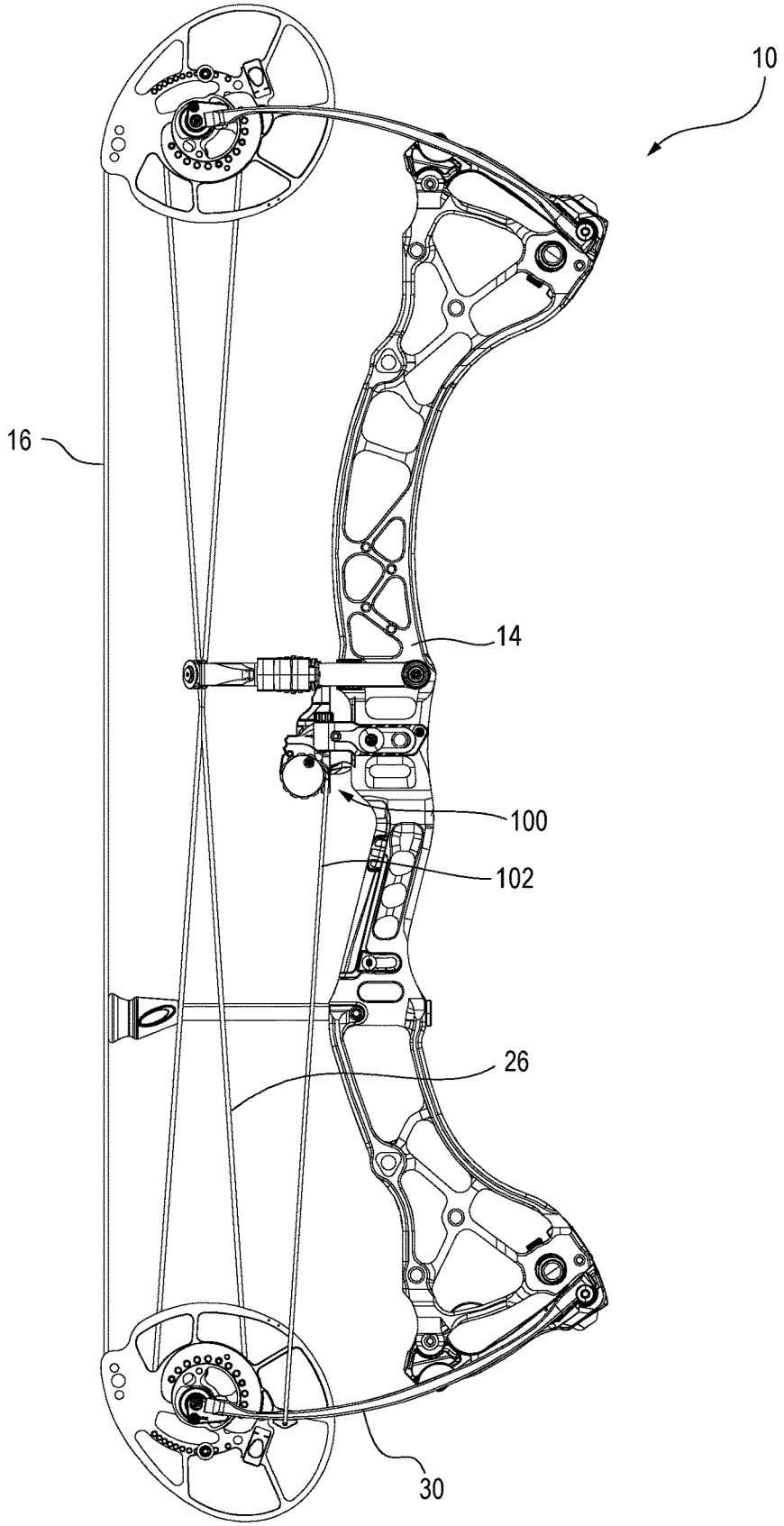
FIG. 3 is a schematic view of an archery bow with a limb driven arrow rest shown in the braced position.
Figure 4:
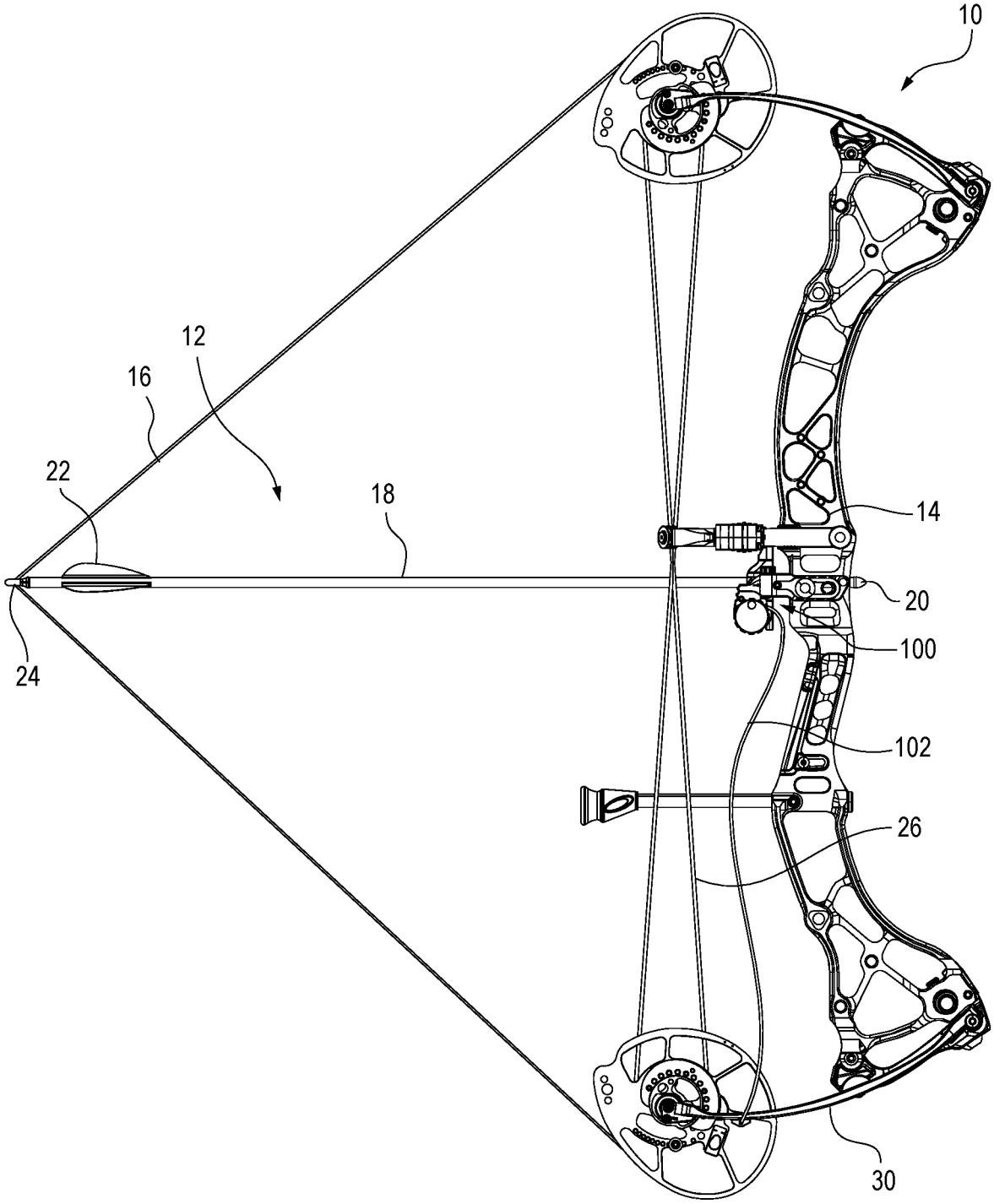
FIG. 4 is a schematic view of an archery bow with a limb driven arrow rest of FIG. 3 shown in the drawn position.

Turning to FIGS. 1-4, a bow 10, such as a compound or a recurve bow, can incorporate an arrow rest 100 to assist in shooting an arrow 12 from the bow 10. The arrow rest 100 may be mounted on the frame 14 of the bow 10 to provide a stable aiming guide. When the bowstring 16 is pulled to the drawn position, the arrow rest 100 may be in an upward position to support the shaft 18 of the arrow 12 proximate its head end 20 during aiming (FIGS. 2 and 4). When the bowstring 16 is released to shoot the bow 10, a portion of the arrow rest 100 may begin to move to a downward position such that the arrow rest 100 does not interfere with the fletching 22 at the tail end 24 of the shaft 18 as the arrow 12 is propelled forward by the bowstring 16 during firing.

In some embodiments, as illustrated in FIGS. 1 and 2, the arrow rest 100 may be a "cable driven rest." A cable driven rest may include a biasing member, such as a spring, that biases the arrow rest 100 to the downward position. The arrow rest 100 may be coupled to a rest cord 102 that can bias the arrow rest 100 to its upward position when the rest cord 102 is pulled tight or under tension. An opposite end of the rest cord 102 may be coupled, directly or indirectly, to a bow cable, control cable, buss cable, or power cable 26 of the bow 10. In other embodiments, the rest cord 102 may be coupled, directly or indirectly, to the bowstring 16. The end of the rest cord 102 may be fixed to a set point along the power cable 26 using a clip 28 or other mechanism such that when the bowstring 16 is in its fully drawn position, the rest cord 102 is taught and the tension in the rest cord 102 forces or pulls the arrow rest 100 to its upward position. As the bow 10 is fired and the bowstring 16 and power cable 26 begin to move to their loose or brace position, the rest cord 102 begins to go slack and the spring or biasing member of the arrow rest 100 forces the arrow rest 100 to its downward position.

In some embodiments, as illustrated in FIGS. 3 and 4, the arrow rest 100 may be a "limb driven rest." A limb driven rest can operate similar to a cable driven rest, but with the arrow rest 100 spring or biasing member instead biasing the arrow rest to its upward position. The rest cord 102 of a limb driven rest may be coupled, directly or indirectly, to a limb 30 of the bow 10, such that when the bow 10 is in its brace position, the rest cord 102 is taught and the tension in the rest cord 102 forces or pulls the arrow rest to its downward position. As the bowstring 16 is drawn, the limbs 30 may flex towards each other to reduce the distance between the distal ends of the limbs 30 and the arrow rest 100 mounted on the frame 14. This reduced distance may allow the rest cord 102 to slack and the spring or biasing member of the arrow rest 100 in turn biases the arrow rest 100 to its upward position. Thus, the arrow rest 100 may be biased to its upward position when the bow 10 is drawn and forced to its downward position by the rest cord 102 when the bow 10 is fired.

For either a "cable driven" or a "limb driven" arrow rest, the "timing" of when or how quickly the arrow rest 100 drops to its downward position can be adjusted by adjusting the tension in the rest cord 102 (e.g., by adjusting the effective length of the rest cord 102 between the arrow rest 100 and the fixed point attached to either the power cable 26 or the limb 30). A user may need to adjust the timing as cables and strings stretch over time, as environmental conditions change, or to adjust for different arrows, shots, or other parameters. As such, a system and method for quickly and easily adjusting the timing of an arrow rest is desirable. Further, a system and method that allows for fine tune adjustments is also desirable.

Figure 5:
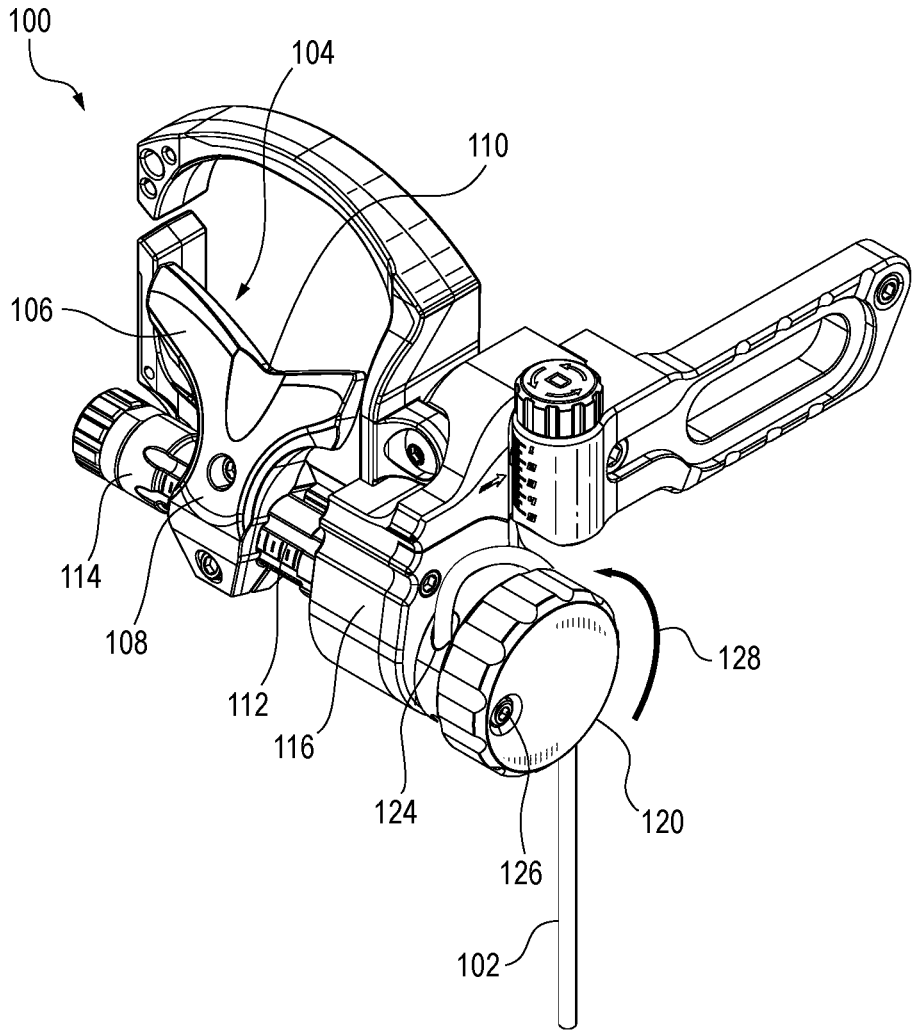
FIG. 5 is a perspective view of an arrow rest having a launcher in an upward position.
Figure 6:
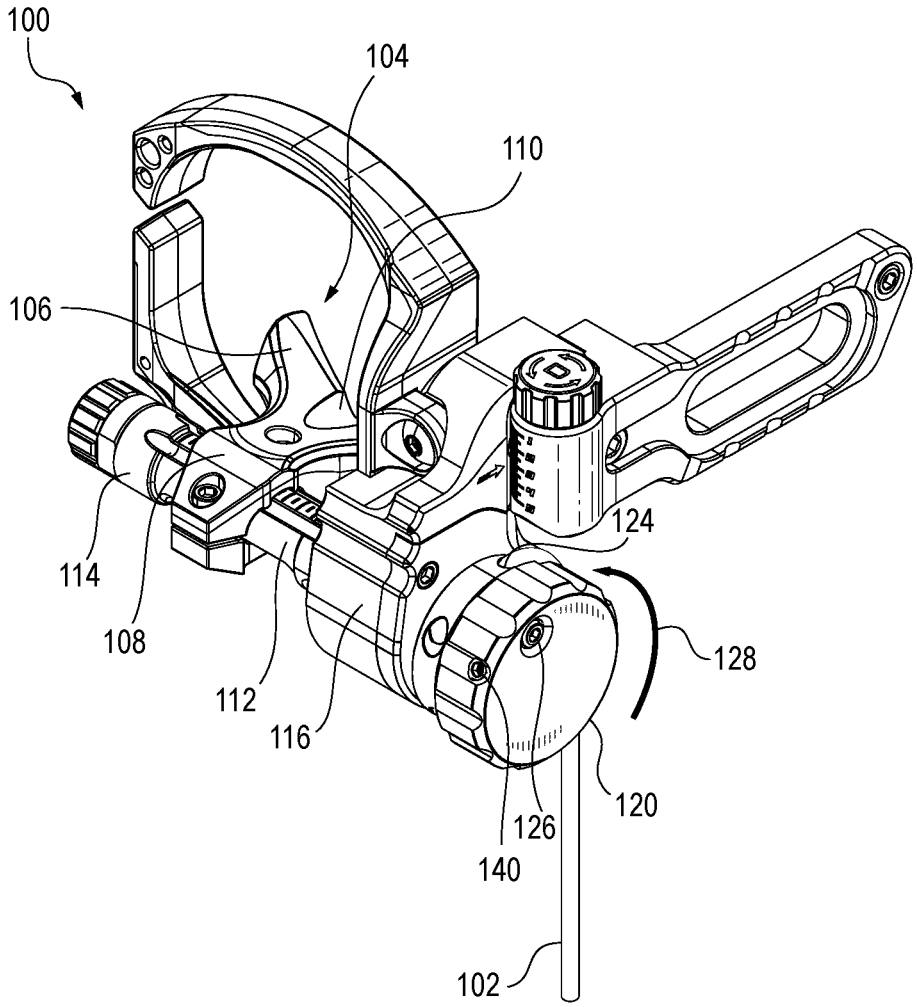
FIG. 6 is perspective view of the arrow rest of FIG. 5 having the launcher in a downward position.

As shown in FIGS. 5-9, an arrow rest 100 may include a launcher 104 configured to engage the arrow shaft 18. As shown, the launcher 104 may include two arms 106 that converge at a base 108 to form a channel or notch 110 for holding the arrow shaft 18. The launcher 104 may be coupled to a launcher arm shaft 112 such that the shaft 112 can rotate the launcher 104 between its downward and upward positions. For example, as shown in FIGS. 5-9, a first end 114 of the shaft 112 may be rigidly connected to the base 108. The arrow rest 100 may include a housing or mount body 116 configured to mount or attach to a bow 10. The mount body 116 may also include an aperture 118 (shown in FIG. 7) configured to receive the shaft 112. The aperture 118 may be configured to allow the shaft 112 to freely rotate while retaining the shaft 112 in a lateral position relative to the mount body 116. The arrow rest 100 may also include stops (not shown) that prevent the shaft 112 from rotating beyond positions that correspond to the fully upward or fully downward positions of the launcher 104. The arrow rest 100 may include a biasing element (not shown), such as a spring (e.g., a torsional spring) that biases the shaft 112 to a corresponding upward or downward position of the launcher 104. For example, as shown in FIG. 5, the shaft 112 is biased to a position that corresponds to the upward position of the launcher 104. This biasing element may be located within the mount body 116.

The shaft 112 may also be coupled to the rest cord 102 such that tension in the rest cord 102 can bias the shaft 112 and launcher 104 in the opposite direction of the biasing element. As shown in FIGS. 5-9, the rest cord 102 may be coupled to a turn knob 120, which may be further coupled to the shaft 112. In some embodiments, as shown, the turn knob 120 may be located on a side of the mount body 116 opposite the launcher 104, and the turn knob 120 may be coupled to a second end 122 of the shaft 112. The turn knob 120 may include a cord aperture 124 for receiving the rest cord 102. The cord aperture 124 may be a secant through-hole (as shown) or a blind hole. The cord aperture 124 may have a diameter slightly larger than the rest cord 102 so that the rest cord 102 can be inserted into the cord aperture 124. The turn knob 120 may include a fastener or cord locking set screw 126 configured to hold or release the rest cord 102 within the cord aperture 124. For example, as shown, the cord locking set screw 126 may be configured to travel approximately perpendicular to the length of the cord aperture 124 as it is tightened or loosened such that the cord locking set screw 126 can engage or bite into the rest cord 102 to fixedly hold a portion of the rest cord 102 within the turn knob 120 when it is tightened. The cord locking set screw 126 may have an end exposed and accessible on the outer profile of the turn knob 120 and may be adjustable using a hex key, allen wrench, or similar tool.

The cord aperture 124 may be offset from the axis of rotation of the turn knob 120 such that pulling the rest cord 102 tight while it is fixedly engaged within the cord aperture 124 (e.g., by a tightened cord locking set screw 126) results in rotation of the turn knob 120. This can in turn result in rotation of the shaft 112 and the launcher 104. Thus, when the rest cord 102 is pulled taught (e.g., by the limb 30 when the bow 10 is fired), the launcher 104 can be rotated to its downward position.

Figure 7:
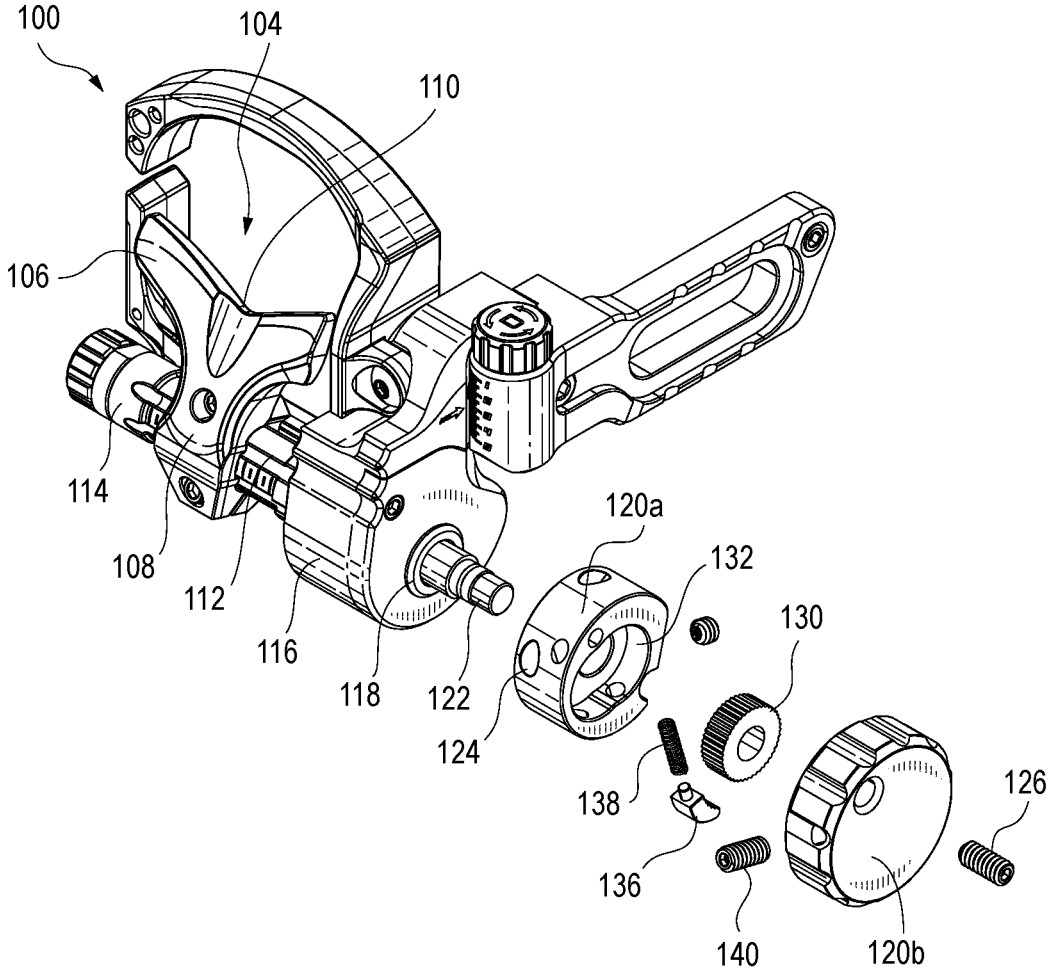
FIG. 7 is a partially exploded perspective view of a turn knob of the arrow rest of FIG. 5.
Figure 8:
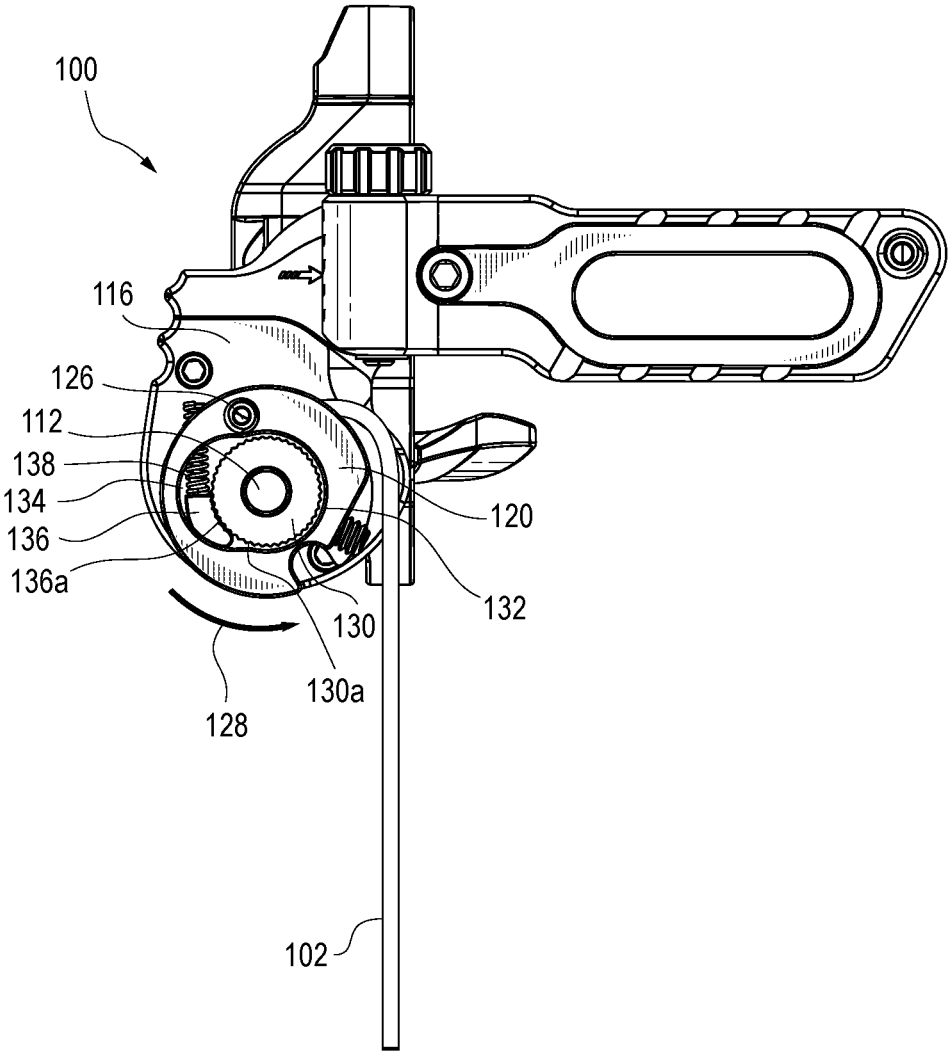
FIG. 8 is a side view of the turn knob of the arrow rest of FIG. 5 with the turn knob cap removed.
Figure 9:
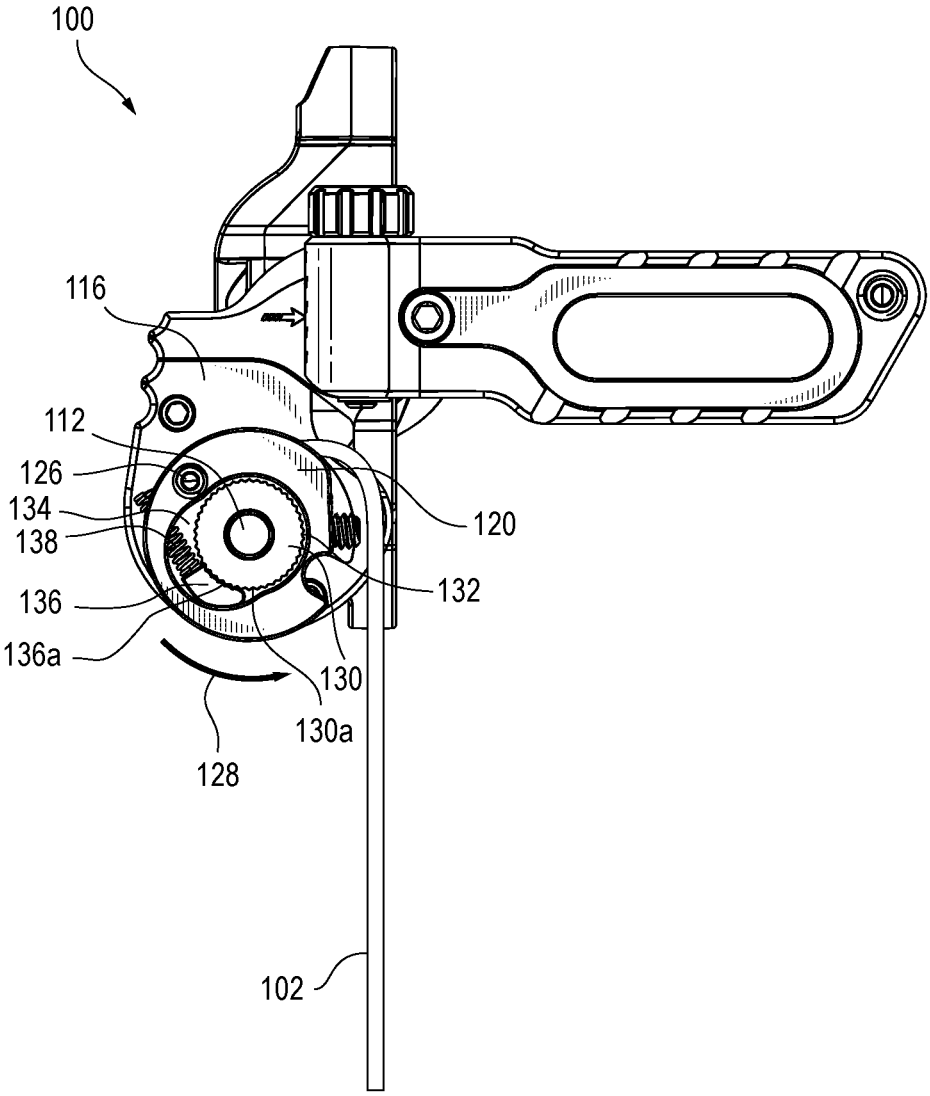
FIG. 9 is another side view of the turn knob of the arrow rest of FIG. 5 with the turn knob cap removed and shown rotated to a different position.

The turn knob 120 may be configured to rotate freely in a direction of free rotation 128 without transferring any rotation to the shaft 112. The turn knob 120 may further be configured to engage and rotate the shaft 112 when rotating in the opposite direction of free rotation 128. This directionally selective transfer of rotation from the turn knob 120 to the shaft 112 may be achieved using a ratchet system. For example, as shown in FIGS. 5-9, a gear 130 may be rigidly coupled to the shaft 112 and received within an internal cavity 132 of the turn knob 120. The internal cavity 132 may generally be configured to house the gear 130 while allowing for some tolerance. As shown in FIG. 7, the internal cavity 132 may be located in a main turn knob housing **120*a*, and a turn knob cap 120*b* may be coupled to the turn knob housing 120*a* to cover and retain components such as the gear 130. The internal cavity 132 may also include a recessed portion 134 configured to retain and engage a pawl 136. A biasing member, such as a compression spring 138, may be used to bias or push the pawl 136 to an end of the recessed portion 134 such that the pawl 136 and gear 130 may engage each other. The pawl 136 may include teeth 136*a* that are sized and spaced to correspond to teeth 130*a* of the gear 130**.

When the turn knob 120 is rotated against the direction of free rotation 128, the pawl 136 may be forced or wedged against a wall or surface of the recessed portion 134. For example, the recessed portion 134 may have a tapered wall such that an angled pawl 136 is wedged between the recessed portion 134 and the gear 130 when rotated against the direction of free rotation 128. The teeth **130*a*, 136*a* of the gear 130 and pawl 136 may engage each other such that the rotation of the pawl 136 is further transferred to the gear 130, which in turn rotates the shaft 112**.

When the turn knob 120 is rotated in the direction of free rotation 128, the recessed portion 134 may be configured to allow the pawl 136 space to skip across the teeth 130*a* of the gear 130. The compression spring 138 may be configured to compress to allow movement of the pawl 136 during this skipping or ratcheting while still keeping the pawl 136 pushed against the recessed portion 134 so that the pawl 136 can stay in alignment to engage the gear 130 in the event that rotation of the turn knob 120 is reversed. As such, the turn knob 120 and the rest cord 102 coupled thereto may be allowed to rotate freely in the direction of free rotation 128, but may rotate the shaft 112 and launcher 104 when rotating against the direction of free rotation 128. The turn knob 120 and rest cord 102 may also be limited by any "stops" that prevent rotation of the shaft 112 beyond a set limit.

As described above, the effective length of rest cord 102 between its fixed attachment at the turn knob 120 and its fixed attachment on a portion of the bow 10 can affect the timing of the arrow rest 100 by determining how quickly or slowly the launcher 104 rotates downward or upward when the bow 10 is fired. A user may roughly adjust the effective length and tension in the rest cord 102 by loosening the cord locking set screw 126, adjusting the rest cord 102 within the cord aperture 124, and retightening and locking the cord locking set screw 126 to hold the rest cord 102 in a fixed position. A user may also precisely adjust the effective length and tension using the turn knob 120 and its ratcheting mechanism. For example, a user may shorten the effective length of the rest cord 102 by rotating the turn knob 120 in the direction of free rotation 128. As shown, the turn knob 120 may be located on an outermost side portion of the arrow rest 100, which can allow clearance between the rest cord 102 and various components of the arrow rest 100 and bow 10 as well as allow for ergonomic access to the turn knob 120.

A user can measure the fine adjustment by feeling or hearing the number of "clicks" of the turn knob as the teeth 130*a*, 136*a* skip across each other (via audible and haptic feedback). For example, the gear 130 may include 42 total teeth spaced evenly around its circumference. Thus, each click could correspond to approximately 8.5° of rotation of the turn knob 120, for example. The cord aperture 124 may be offset a distance D1 from the axis of rotation of the turn knob 120. For example, D1 may be approximately 0.4 inches. Thus, rotating the turn knob 120 one "click" would result in approximately 1/16th (0.0625) inches of slack being taken out of the effective length of the rest cord 102. The arrow rest 100 may be configured to include other numbers of teeth 130*a* and/or a different distance D1 such that the arrow rest 100 can have an effective take-up length per "click" as desired.

As best shown in FIGS. 5 and 7, the turn knob 120 may include a fastener or turn knob locking set screw 140 that can lock the turn knob 120 into rotational engagement with the shaft 112. The turn knob locking set screw 140 can be tightened such that it frictionally engages a portion of the shaft 112. As such, a user may be prohibited from adjusting the effective length of the rest cord 102 using the turn knob 120 when the turn knob locking set screw 140 is engaged or locked. This may help prevent inadvertent adjustments once a user has adjusted the timing to a preferred setting. A user can loosen or unlock the turn knob locking set screw 140 to provide free rotation and further adjustments if needed. Similar to the cord locking set screw 126, the turn knob locking set screw 140 may have an end exposed and accessible on the outer profile of the turn knob 120 and may be adjustable using a hex key, allen wrench, or similar tool. Overall, this system can utilize simple, readily available tools to make adjustments and can allow for efficient testing and adjustment of the timing in the field.

Although the figures illustrate an arrow rest 100 having its launcher 104 biased towards the upward position and the rest cord 102 rotating the launcher 104 to its downward position when drawn or pulled tight (e.g., a limb driven rest), it should be understood that the arrow rest 100 may be configured to have its launcher 104 biased toward the downward position and the rest cord 102 configured to rotate the launcher to its upward position when drawn or pulled tight (e.g., a cable driven rest). In general, it should be apparent to one of ordinary skill in the art that any of the embodiments described and illustrated herein are capable of being configured to operate as either a cable driven rest or a limb driven rest, unless specifically noted otherwise.

Figure 10:
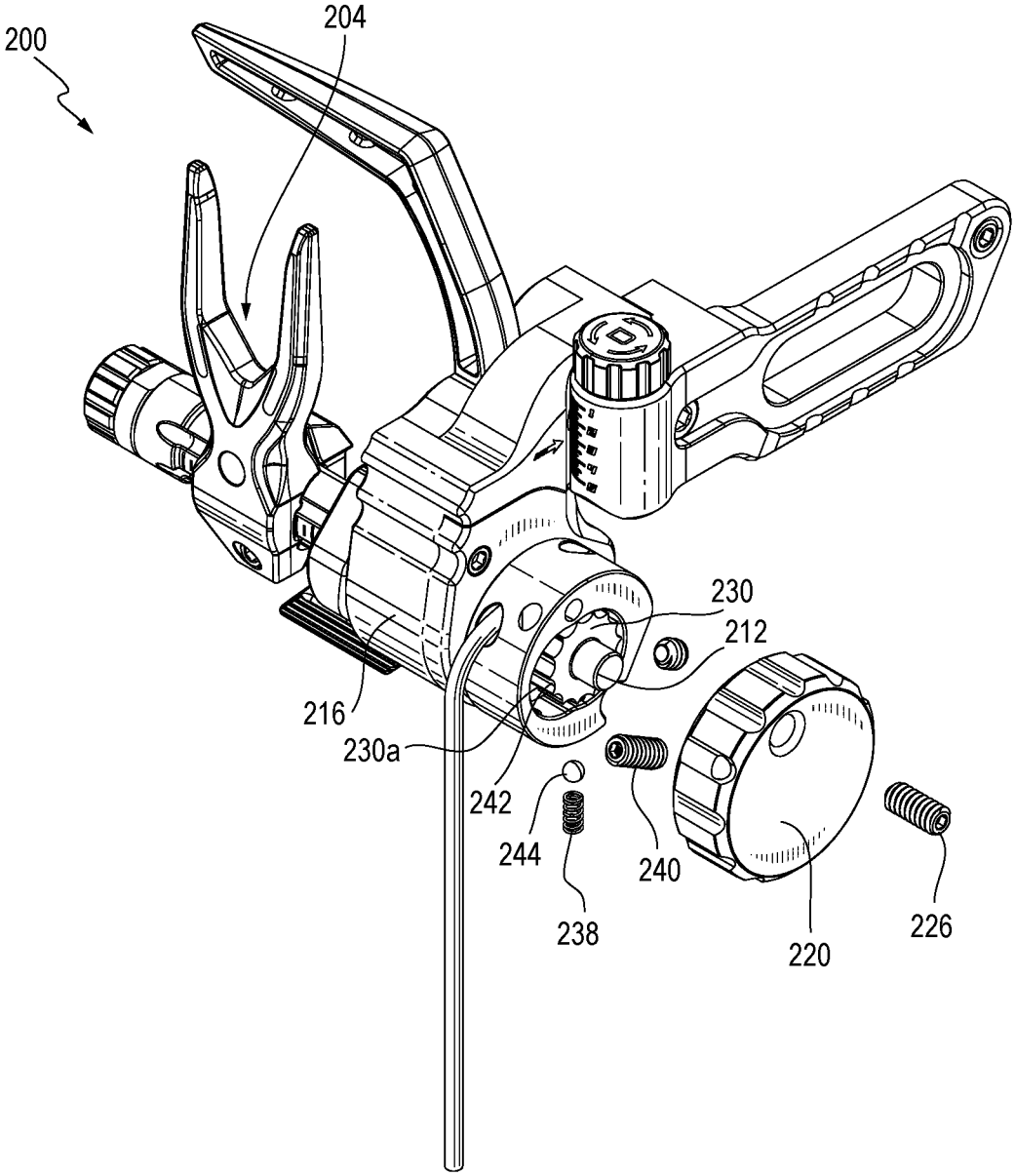
FIG. 10 is a partially exploded perspective view of a turn knob of another embodiment of an arrow rest.

FIG. 10 illustrates another embodiment of an arrow rest 200. Features that are similar to the arrow rest 100 shown in FIGS. 5-9 are identified with similar reference numbers, plus 100. Some similarities and differences between the arrow rest 200 and arrow rest 100 are described herein.

Figure 10A:
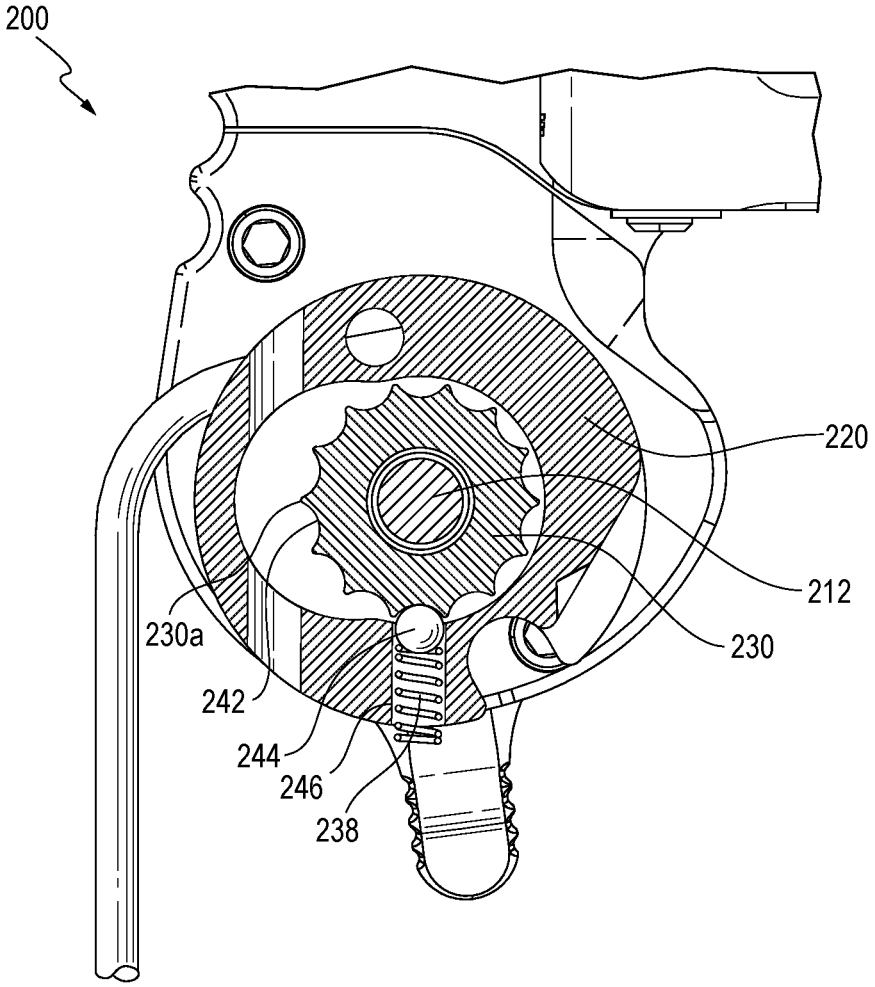
FIG. 10A is side view of the turn knob of the arrow rest of FIG. 10 with the turn knob cap removed.

The turn knob 220 of the arrow rest 200 may be allowed to rotate freely in either direction until the turn knob locking set screw 240 locks the turn knob 220 to the shaft 212. The shaft 212 may be coupled to a gear 230, which may include a number of concave profile gear teeth 230*a* (e.g., 14 teeth 230*a*, as shown). The concave portion 242 of the teeth 230*a* may be configured to receive a detent ball 244 or similar rounded object. The detent ball 244 may be biased radially inwards to engage the gear 230 by a biasing member such as a compression spring 238. The compression spring 238 and a portion of the detent ball 244 may be held within a radially extending aperture or channel 246 (see FIG. 10A) of the turn knob 220. As the turn knob 220 rotates, the detent ball 244 may be allowed to ride up or rise up along the smooth concave portion 242 of the gear 230. The compression spring 238 may provide some resistance to the rising of the detent ball 244, so some force may be needed to rotate the turn knob 220. As the detent ball 244 passes over the crest of a gear tooth 230*a*, it may begin to fall into the adjacent concave portion 242 and the compression spring 238 may begin to bias the turn knob to rotate to an alignment where the detent ball 244 once again resides at the bottommost portion of the of the concave portion 242. As such, the detent ball 244 and spring 238 provide resistance to the free movement of the turn knob 220, but a sufficient amount of force/torque applied to the turn knob 220 will overcome the resistance and the detent ball 244 is allowed to fall in and out of concave portions 242 of the gear 230 as the turn knob 220 is rotated.

Because the detent ball 244 and concave portions 242 may be symmetrical, the turn knob 220 can be bi-directionally rotated. Consequently, the effective length or tension in the rest cord 202 may be increased or decreased in minor increments using only the turn knob 220. A user can tighten the turn knob locking set screw 240 once the desired adjustment to the rest cord 202 has been made to lock the turn knob 220 into position relative to the shaft 212 and allow any tension in the rest cord 202 to be transferred to the shaft 212 and launcher 204.

Similar to arrow rest 100, arrow rest 200 can provide audible and haptic feedback as the turn knob 220 is rotated by "clicks" as the detent ball crests over a gear tooth 230*a* and falls into a concave portion 242. As shown in the illustrated embodiment, the gear 230 may include 14 teeth 230*a* and concave portions 242. Accordingly, rotating the turn knob 220 one "click" may correspond to a rotation of approximately 18.6°, which may correspond to an adjustment of approximately 0.18 inches if the cord aperture 224 offset distance D1 is approximately 0.4 inches.

Figure 11:
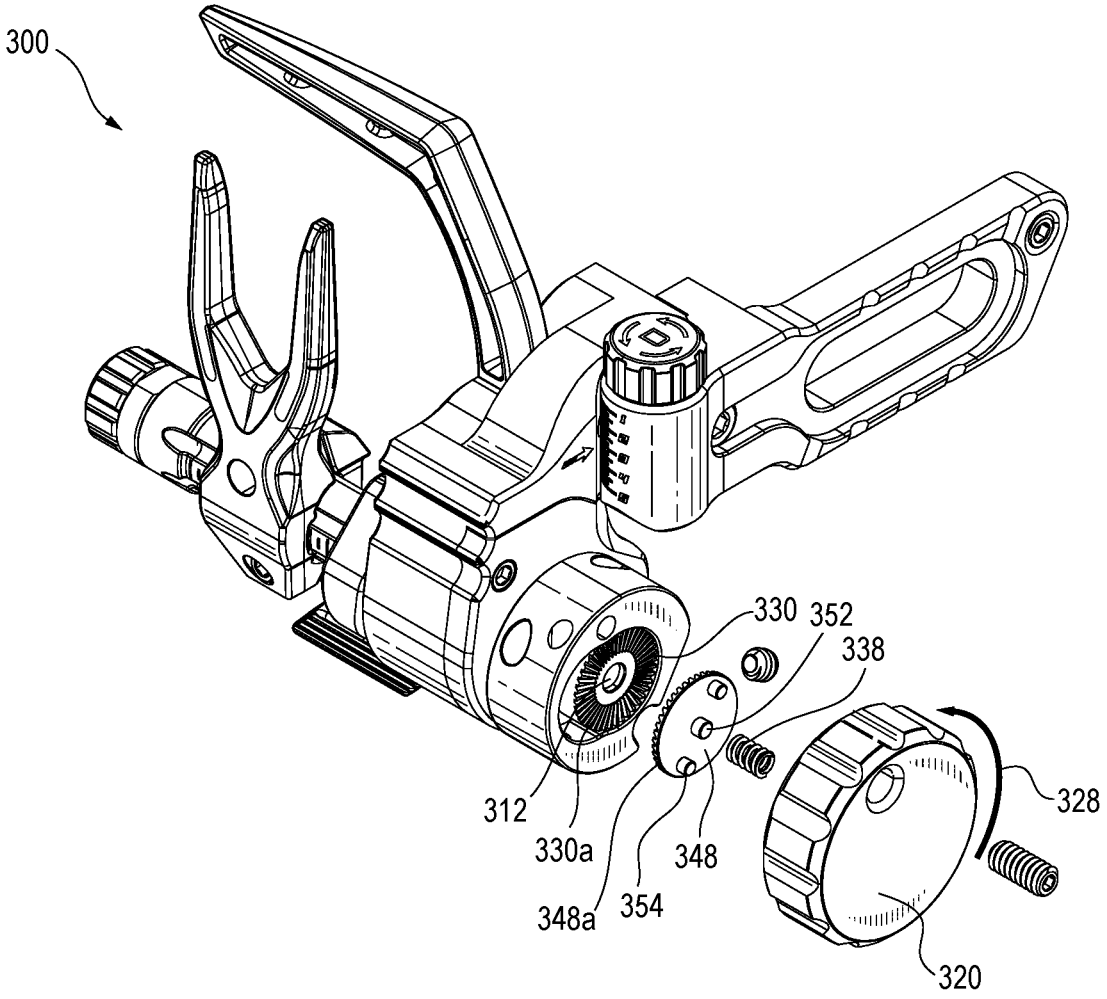
FIG. 11 is a partially exploded perspective view of a turn knob of another embodiment of an arrow rest.
Figure 12:
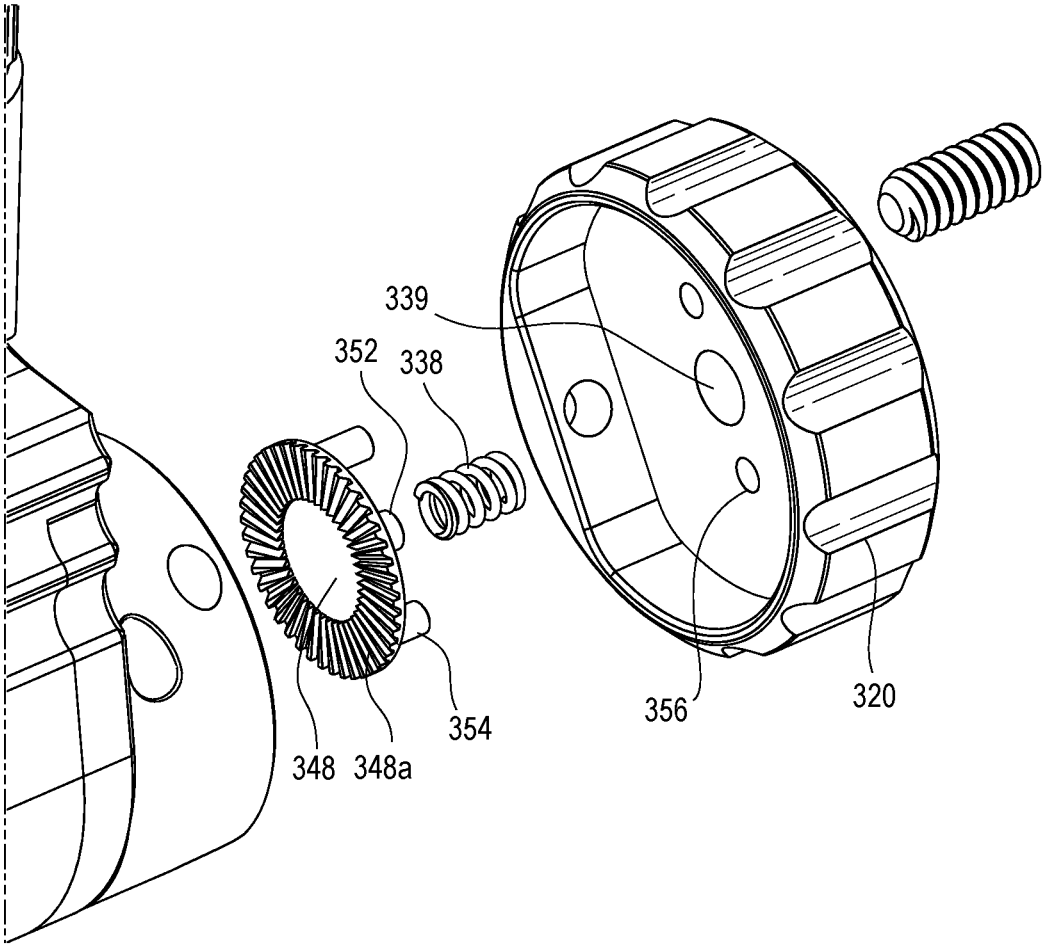
FIG. 12 is a partially exploded perspective view of the turn knob of FIG. 11.

FIGS. 11 and 12 illustrate another embodiment of an arrow rest 300. Features that are similar to the arrow rest 100 shown in FIGS. 5-9 are identified with similar reference numbers, plus 200. Some similarities and differences between the arrow rest 300 and arrow rest 100 are described herein.

The turn knob 320 may include a geared clutch plate 348 configured to engage the gear 330 coupled to the shaft 312. The geared clutch plate 348 may have teeth 348*a* with a wedged profile that allows for rotation of the geared clutch plate 348 in the direction of free rotation 328 as the teeth 330*a*, 348*a* ramp off each other. However, the teeth 330*a*, 348*a* may be configured to interlock and prevent rotation when the turn knob 320 is rotated against the direction of free rotation 328.

The turn knob 220 may include a channel or recess 339 (FIG. 12) for retaining a biasing member such as a compression spring 338. The compression spring 338 may bias the clutch plate 348 against the gear 330, which can help ensure engagement between the teeth 330*a*, 348*a*. Similarly, the clutch plate 348 may include a protrusion 352 that the spring 338 may wrap around to help keep the spring 338 in place on the clutch plate 348. The clutch plate 348 may also include protrusions or pins 354 extending from the disk or face of the clutch plate 348 and to be received within corresponding channels or holes 356 (FIG. 12) in the internal portion of the turn knob 320. The pins 354 can engage the holes 356 so that rotation of the turn knob 320 is translated to rotation of the clutch plate 348 and vice versa while still allowing the clutch plate 348 to move towards and away from the gear 330 as the teeth 330*a*, 348*a* skip across or engage each other. The holes 356 may have a sufficient depth to accommodate this lateral movement of the clutch plate 348 and pins 354, and the pins 354 may have sufficient length to always have engagement within the holes 356 even when the clutch plate 348 is pressed fully against the gear 330. As shown in the illustrated embodiment, two pins 354, and corresponding holes 356 in the turn knob 320, may be located at substantially opposite ends of the clutch plate 348 to help evenly transfer rotation between the components.

Figure 13:
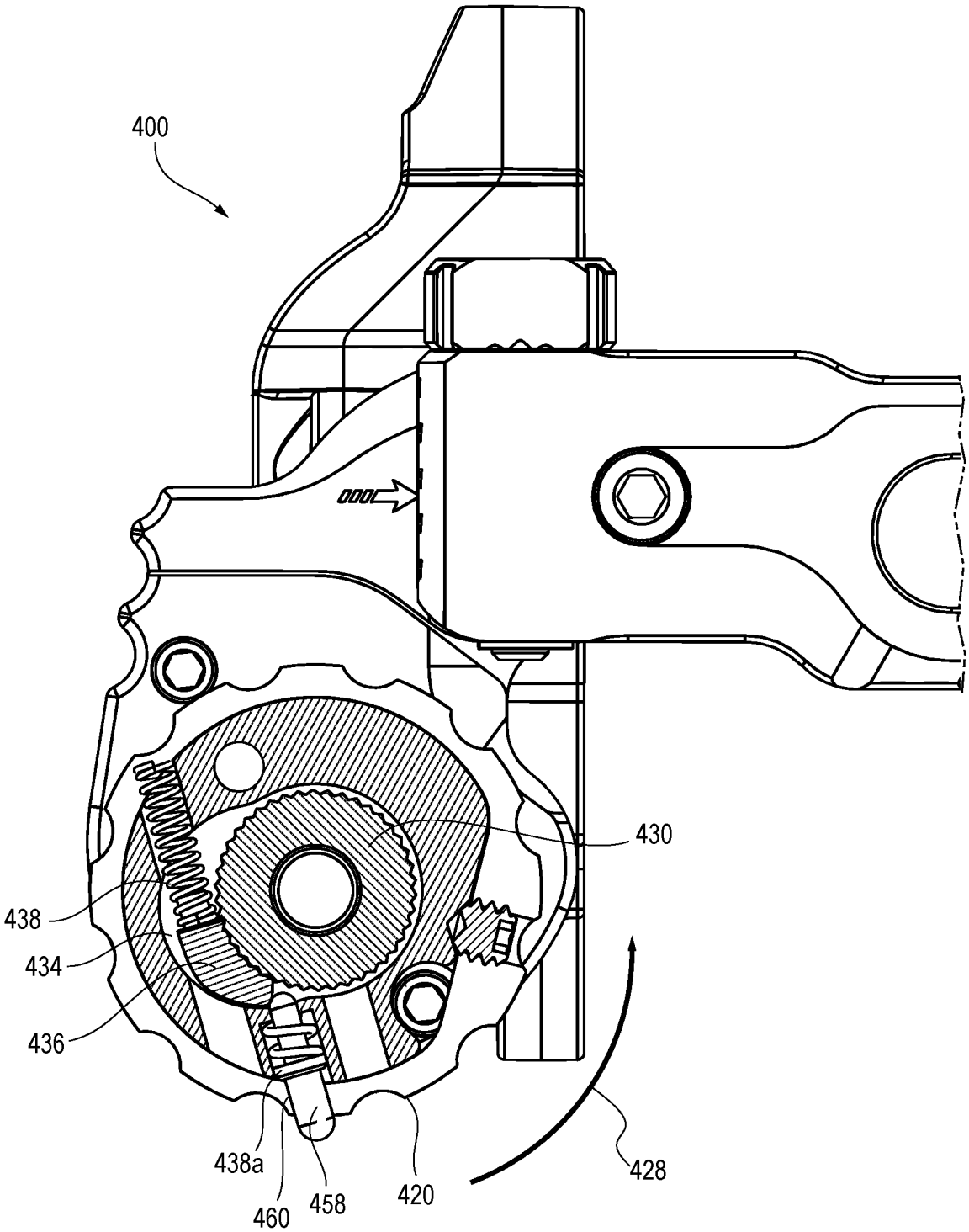
FIG. 13 is a side sectional view of a turn knob of another embodiment of an arrow rest.
Figure 14:
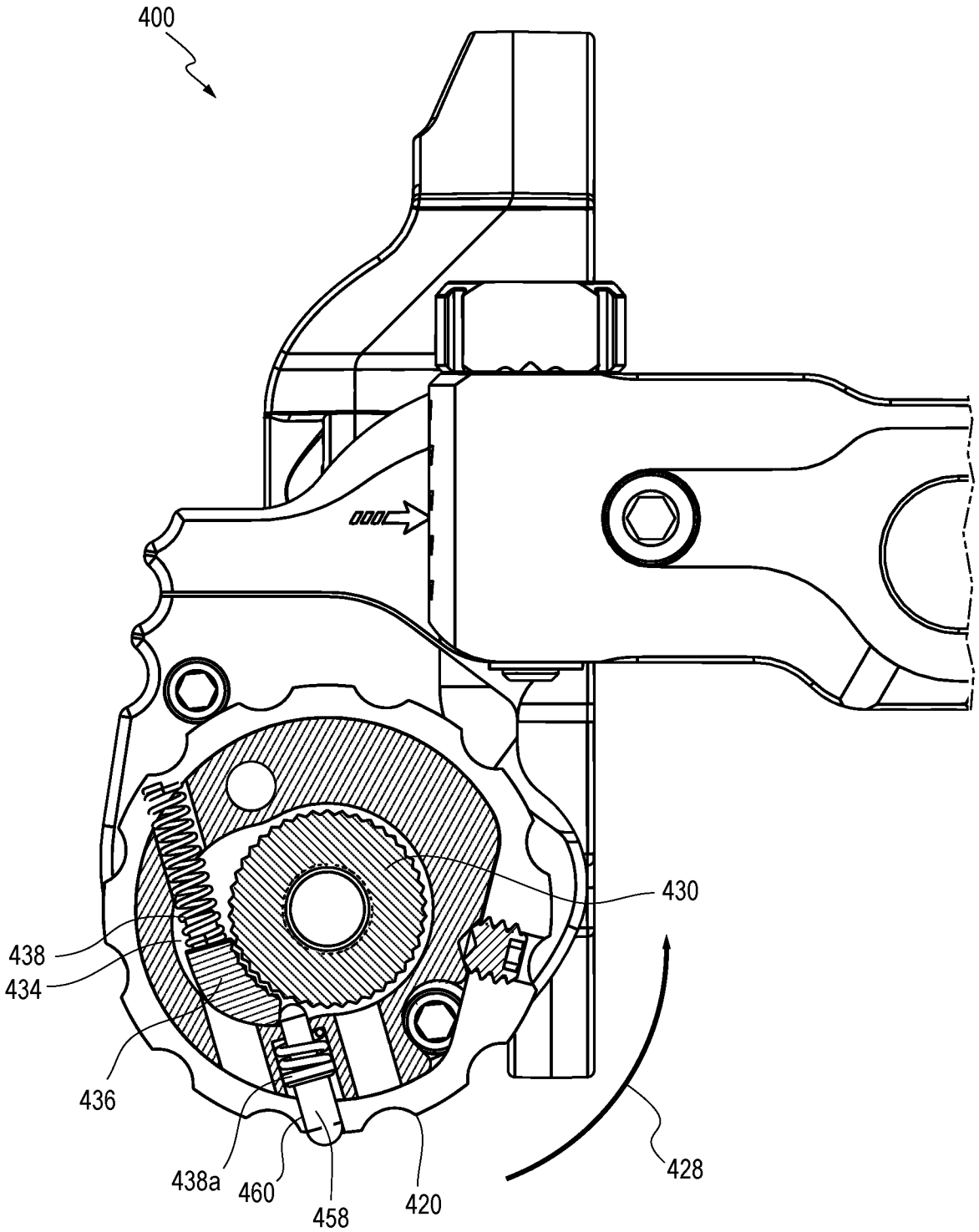
FIG. 14 is another side sectional view of the turn knob of FIG. 13 shown with a push button of the turn knob depressed.

FIGS. 13 and 14 illustrate another embodiment of an arrow rest 400. Features that are similar to the arrow rest 100 shown in FIGS. 5-9 are identified with similar reference numbers, plus 300. Some similarities and differences between the arrow rest 400 and arrow rest 100 are described herein.

The arrow rest 400 may include a push button 458 that can engage or disengage the pawl 436. The push button 458 may be aligned to overcome the bias of the compression spring 438 that biases the pawl 436 to engage the gear 430 and abut a wall or surface of the recessed portion 434. The push button 458 may extend through a hole 460 in the turn knob 420 such that a user may selectively press the push button 458 while rotating the turn knob 420. The push button 458 may be aligned with and engage the pawl 436 such that pressing the push button 458 compresses the spring 438 so that spring 438 does not bias the pawl 436 to its engaged position against the gear 430. Thus, when the push button 458 is pressed, the turn knob 420 is allowed to rotate against the direction of free rotation 428 because the pawl 436 can be pushed or "fall" out of the way of the gear 430 as the turn knob 420 rotates. When the push button 458 is released, the spring 438 may push the push button 458 back out to its undepressed state and may push the pawl 436 back to its engaged position. Further, the push button 458 may have a secondary spring 438*a* that helps ensure the push button 458 is biased back out to its undepressed state when a user is not actively pressing it. Thus, the turn knob 420 can freely rotate bi-directionally when the push button 458 is pressed and can rotate freely only in the direction of free rotation 428 when the push button 458 is released.

A push button 458 may generally be incorporated into other embodiments to disengage the ratcheting components of those embodiments (e.g., by disengaging a biasing element or spring or ratcheting component) and allow bi-directional free rotation while pressed.

In some embodiments (not shown), the turn knob may include a second pawl and a toggle switch. The toggle switch may selectively bias a spring or pawl to engage only one of the pawls to the gear at a time so that the turn knob is capable of ratcheting and freely rotating in either direction depending on the toggle switch selection.

Figure 15:
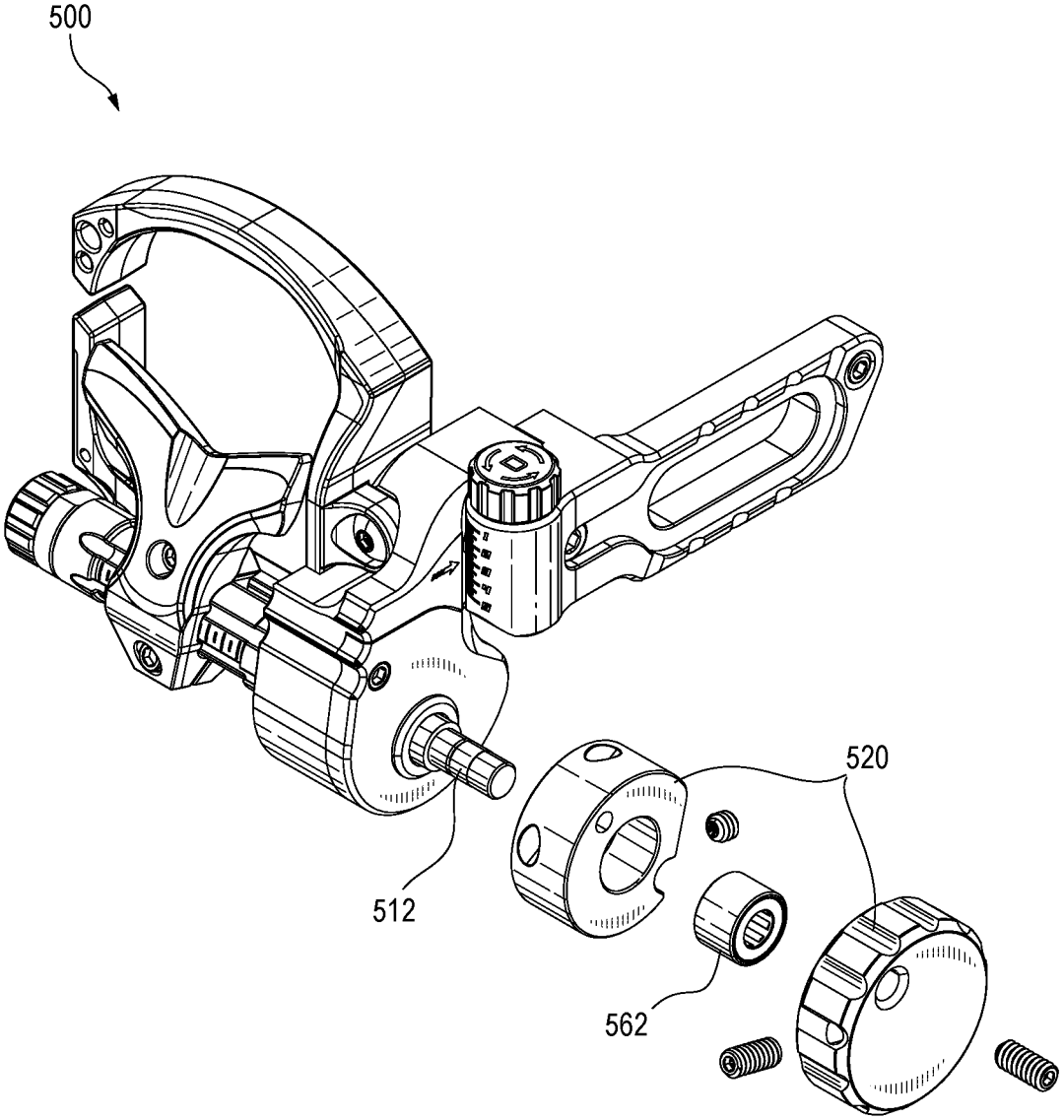
FIG. 15 is a partially exploded perspective view of a turn knob of another embodiment of an arrow rest.

FIG. 15 illustrates another embodiment of an arrow rest 500. Features that are similar to the arrow rest 100 shown in FIGS. 5-9 are identified with similar reference numbers, plus 400. Some similarities and differences between the arrow rest 500 and arrow rest 100 are described herein.

Arrow rest 500 may utilize a one-way clutch bearing 562 fixedly coupled to the turn knob 520. The one-way clutch bearing 562 may surround the shaft 512 and engage and translate rotation of the turn knob 520 to the shaft 512 in one direction while allowing the turn knob 520 and bearing 562 to rotate freely about the shaft 512 in the opposite direction. The one-way clutch bearing 562 may be a one-way needle bearing or other one-way bearing.

Figure 16:
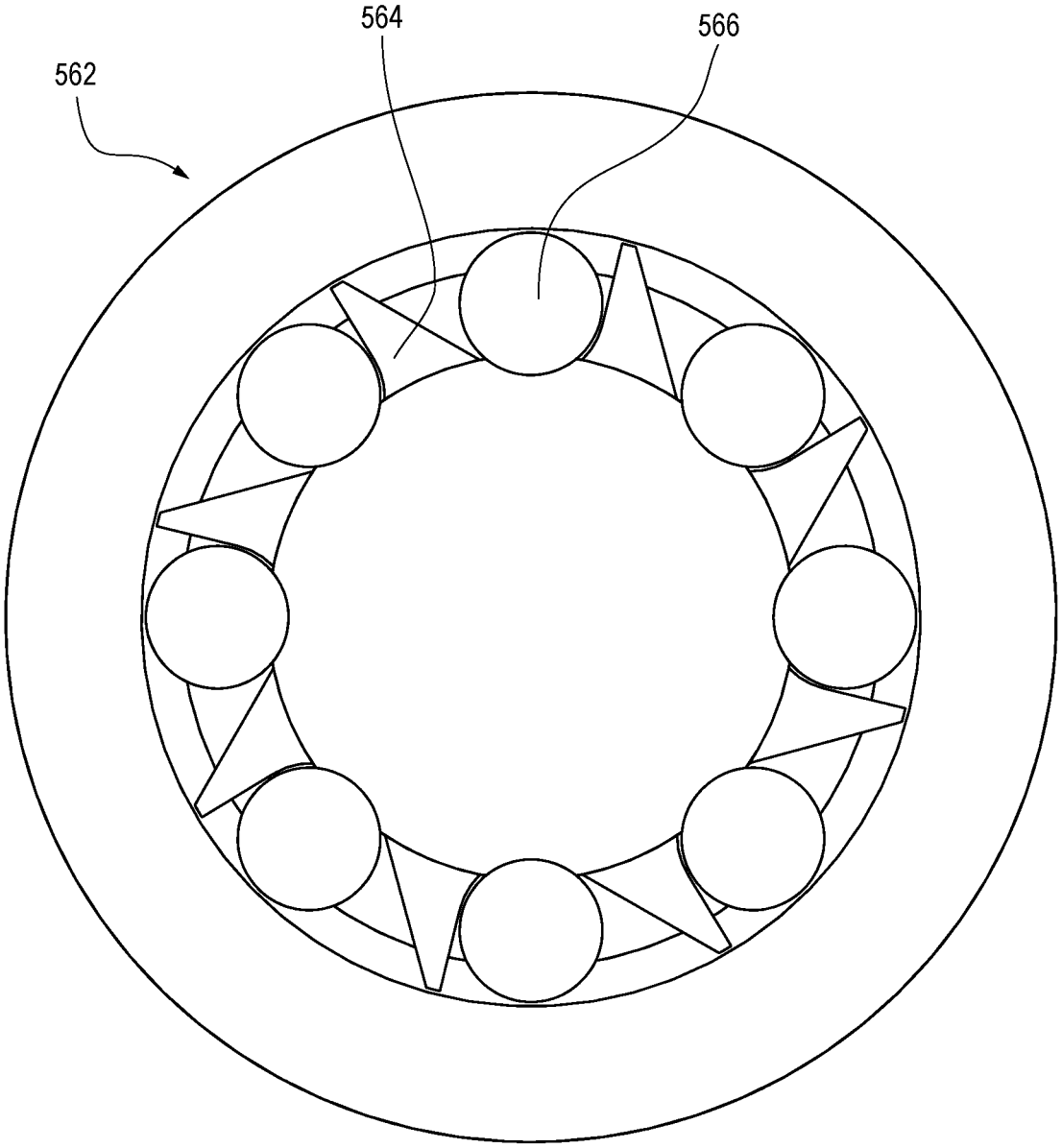
FIG. 16 is a sectional view of a one-way needle bearing as used in the arrow rest of FIG. 15.

As shown in FIG. 16, the needle-style one-way clutch bearing 562 may include needle members 564 and rollers 566. The asymmetric shape of between needle members 564 can allow the rollers 566 to roll over or be pushed back from a central shaft, such as shaft 512, when the clutch bearing 562 is rotated in one direction around the shaft but prevent rotation of the clutch bearing 562 around the shaft when rotated in the opposite direction. When rotated the opposite direction, the asymmetric shape of the needle members 564 prevents the rollers 566 from rolling or being pushed back from the central shaft, and so the rollers 566 frictionally engage the shaft and prevent free rotation of the clutch bearing 562 around the shaft.

Figure 17:
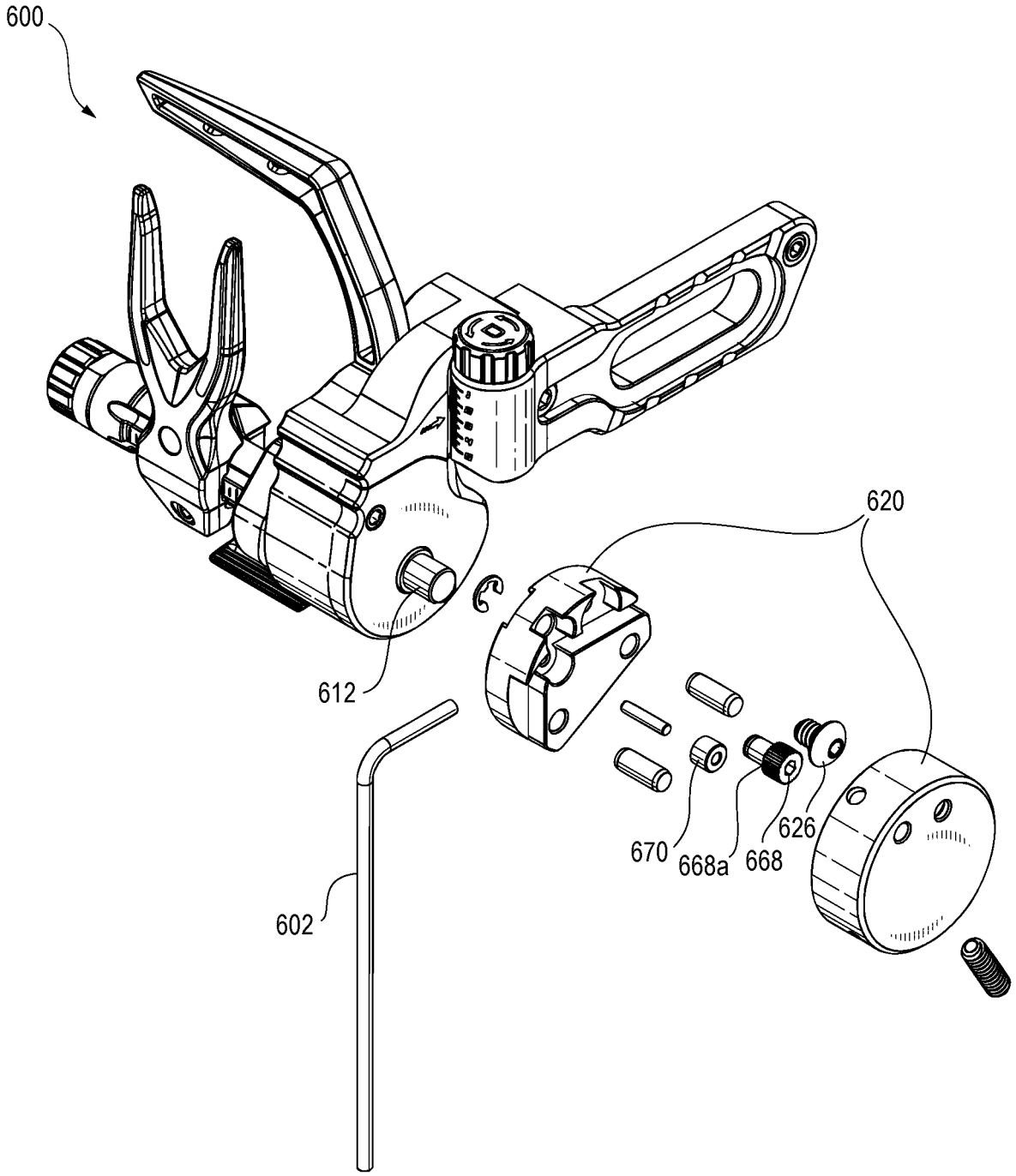
FIG. 17 is a partially exploded perspective view of an arrow rest according to another embodiment.
Figure 18:
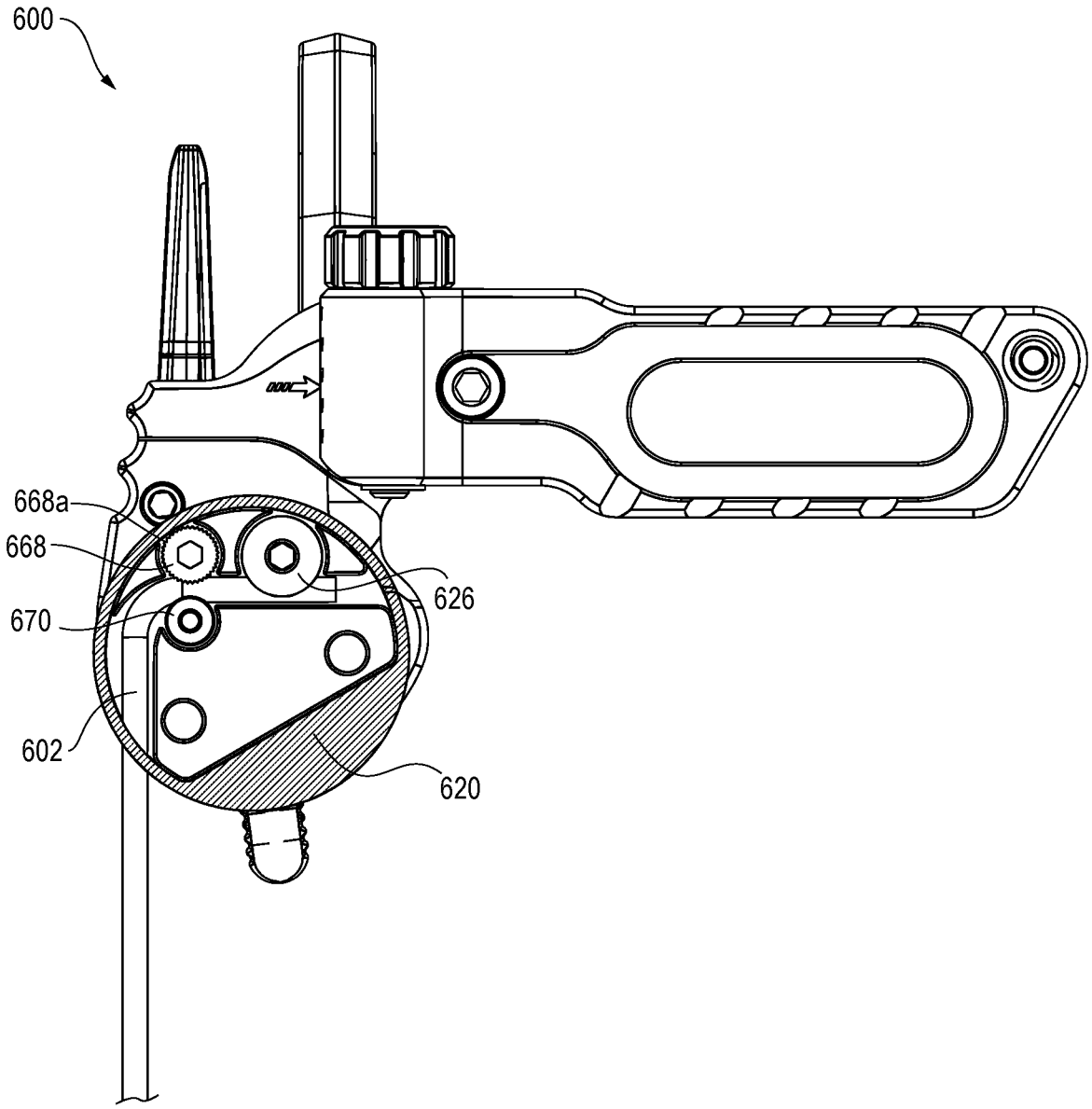
FIG. 18 is a side sectional view of a turn knob of the arrow rest of FIG. 17.

FIGS. 17 and 18 illustrate another embodiment of an arrow rest 600. Features that are similar to the arrow rest 100 shown in FIGS. 5-9 are identified with similar reference numbers, plus 500. Some similarities and differences between the arrow rest 600 and arrow rest 100 are described herein.

Arrow rest 600 may include a turn knob 620 fixedly coupled to the shaft 612 such that any rotation of the turn knob 620 results in rotation of the shaft 612. The rest cord 602 may be received between a first gear 668 and a second gear 670. The gears 668, 670 may be spaced apart a distance such that the rest cord 602 fits snugly between and transfers rotation of the first gear 668 to the second gear 670 without overly compressing or damaging the rest cord 602 (i.e., the first gear 668 may act as a drive gear and the second gear 670 may act as an idler). The first gear 668 may have a face of the gear 668 exposed and may include a hex head or similar fastener head such that a user can manually turn the first gear 668. As the first gear 668 is turned, the gears 668, 670 may bite into or engage the rest cord 602 and force the rest cord 602 to be taken up or let out depending on the direction of rotation of the first gear 668. The gears 668, 670 may include teeth, such as teeth 668*a* as shown in the illustrated embodiment, to enhance biting or friction between the gears 668, 670 and the rest cord 602.

The turn knob 620 may include a cord locking set screw 626 configured to hold the rest cord 602 in a fixed position or release the rest cord 602 for adjustments. As shown in the illustrated embodiment, the head of the cord locking set screw 626 can be tightened onto the rest cord 602 to lock it in place. In other embodiments, the threaded portion of the set screw 626 can be aligned to with the rest cord 602 such that a tip of the set screw 626 engages or bites into the rest cord 602 to hold it in place when tightened.

Figure 19:
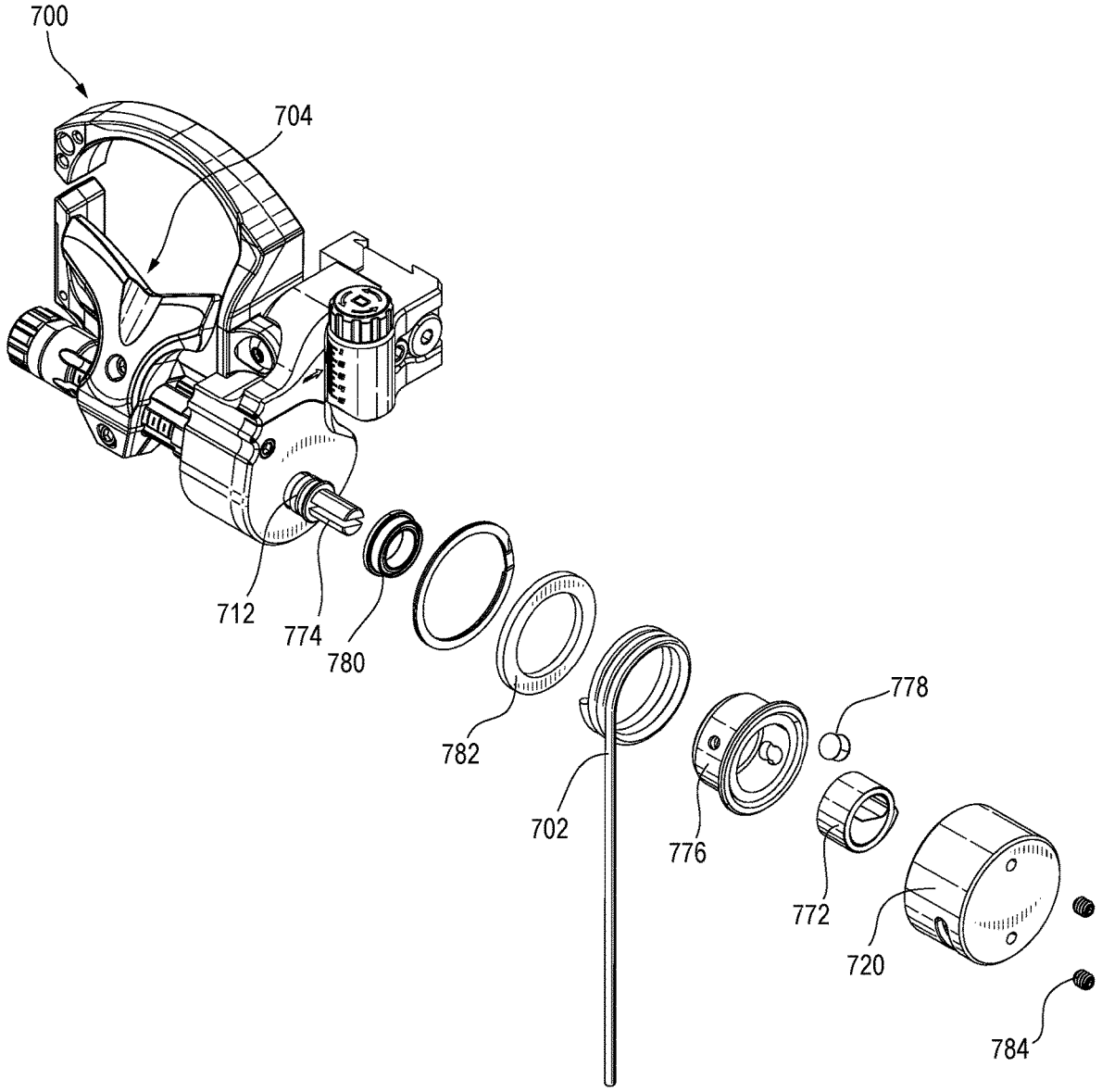
FIG. 19 is a partially exploded perspective view of a portion of an arrow rest according to another embodiment.
Figure 20:
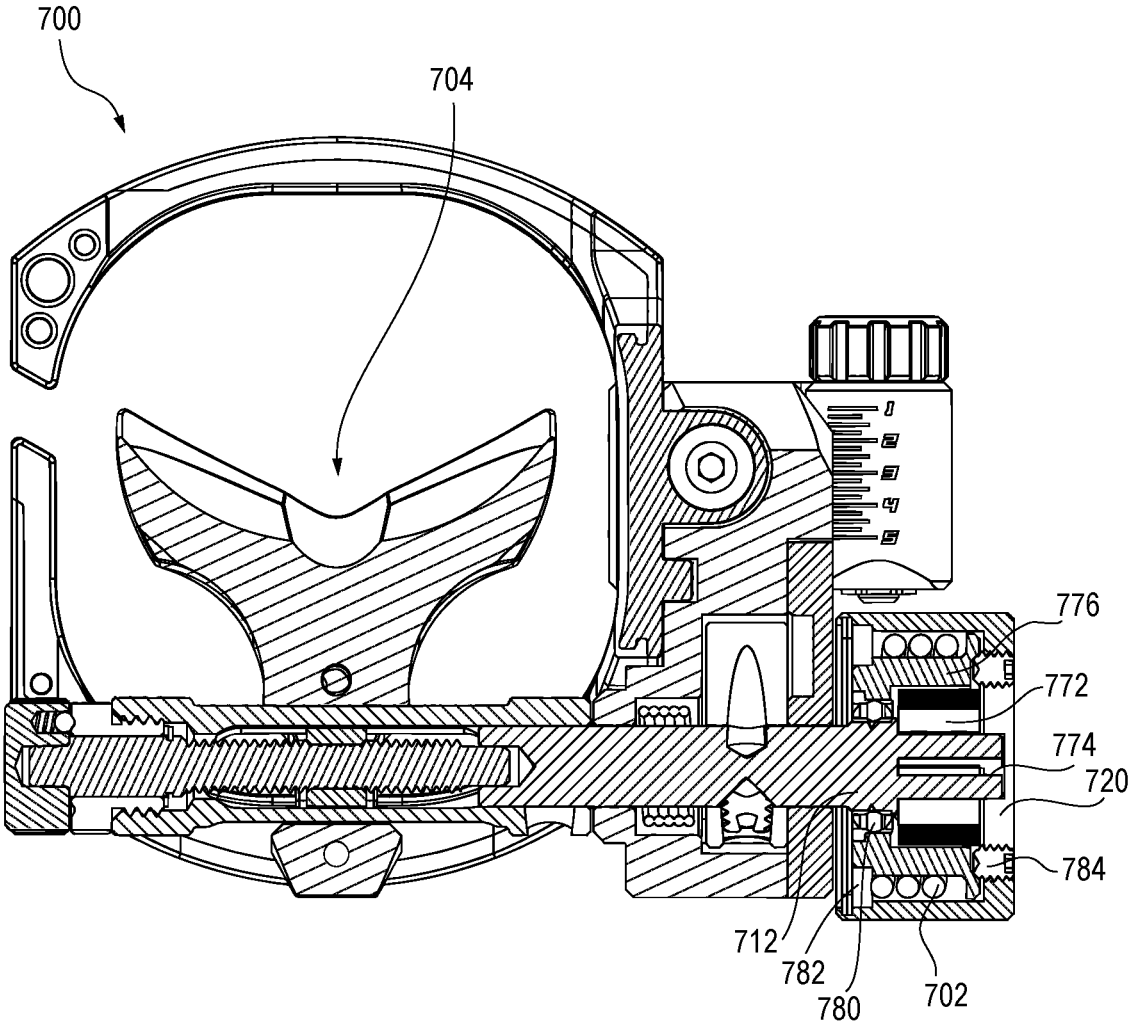
FIG. 20 is a sectional view of the arrow rest of FIG. 19.

FIGS. 19 and 20 illustrate another embodiment of an arrow rest 700. Features that are similar to the arrow rest 100 shown in FIGS. 5-9 are identified with similar reference numbers, plus 600. Some similarities and differences between the arrow rest 700 and arrow rest 100 are described herein.

Arrow rest 700 may include an automatic tensioning system in place of or in addition to a manual tensioning system. Arrow rest 700 may include a turn knob 720 fixedly coupled directly to the shaft 712, such as by press fitting the turn knob 720 to the shaft 712. The arrow rest 700 may include a biasing element such as a coiled torsion spring 772 that is coupled to the shaft 712 and the rest cord 102.

One end of the torsion spring 772 may be coupled to the shaft 712 by engaging a slotted opening 774 in the shaft 712. The other end of the torsion spring 772 may be fixedly coupled to a spool or retainer hub 776 that the rest cord 702 can wrap around. For example, the torsion spring 772 and retainer hub 776 can each include an opening for receiving a rivet 778 that fixedly holds an end of the torsion spring 772 to the retainer hub 776. The rest cord 702 may be spooled or wrapped around or otherwise fixed to the retainer hub 776. For example, the rest cord 702 may have multiple wraps around the outer surface of the retainer hub 776 such that there is sufficient friction to transfer movement of the rest cord 702 to rotation of the retainer hub 776. In other embodiments, a set screw, a crimp or ferrule, or other fixing mechanism can be used in addition or in lieu of using friction and dead wraps to fix the rest cord 102 to the retainer hub 776. The retainer hub 776 may be free to rotate about the shaft 712 and may engage bearings such as a ball bearing 780 about the shaft 712 and/or a plain sleeve bearing 782 that reduces frictions between the retainer hub 776 and mount body 716.

Due to the free rotation of the retainer hub 776, the coiled torsion spring 772 can keep the tension in the rest cord 702 at optimal system tension without the need for manual adjustment. For example, the rest cord 702 may be attached to the bow 10 and pulled tight in the corresponding drawn or brace position of the bow 10 (depending on whether configured as a limb driven or cable driven arrow rest 700), and the torsion spring 772 can set the tension in the rest cord 702 to an ideal setting. Once, this ideal tension is set, the retainer hub 776 can be locked or fixed to the shaft 712. For example, as shown in the illustrated embodiment in FIG. 20, locking set screw(s) 784 may be tightened into the retainer hub 776 to fix the turn knob 720 to the retainer hub 776. Because the turn knob 720 can be fixed to the shaft 712, the rotation of the retainer hub 776 can be transferred to the shaft 712. In other embodiments, the locking set screw(s) 784 may directly lock the retainer hub 776 to the shaft 712. Once locked, pulling the rest cord 702 tighter results in rotation of the shaft 712. For example, in a limb driven arrow rest 700, firing the bow 10 results in the rest cord 102 being pulled tighter and transferring rotation to the shaft 712 such that the launcher 704 is rotated to its downward position with optimal timing.

Figure 21:
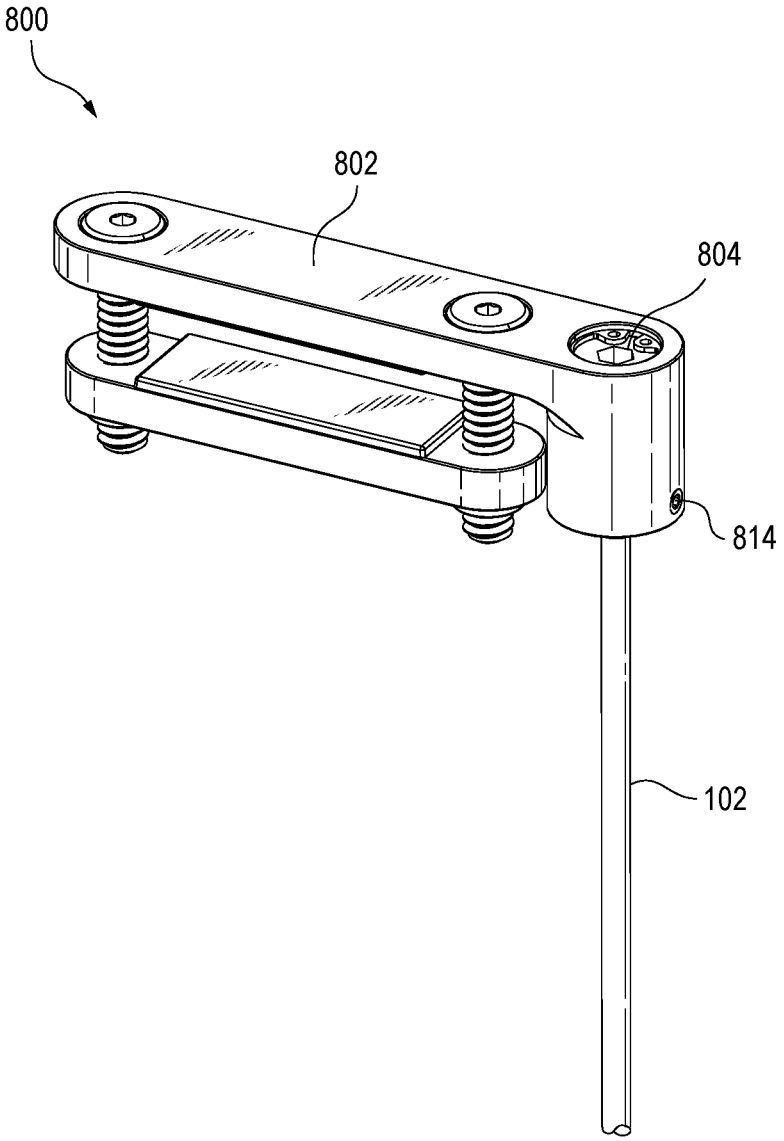
FIG. 21 is a perspective view of a tension adjusting device according to another embodiment.
Figure 22:
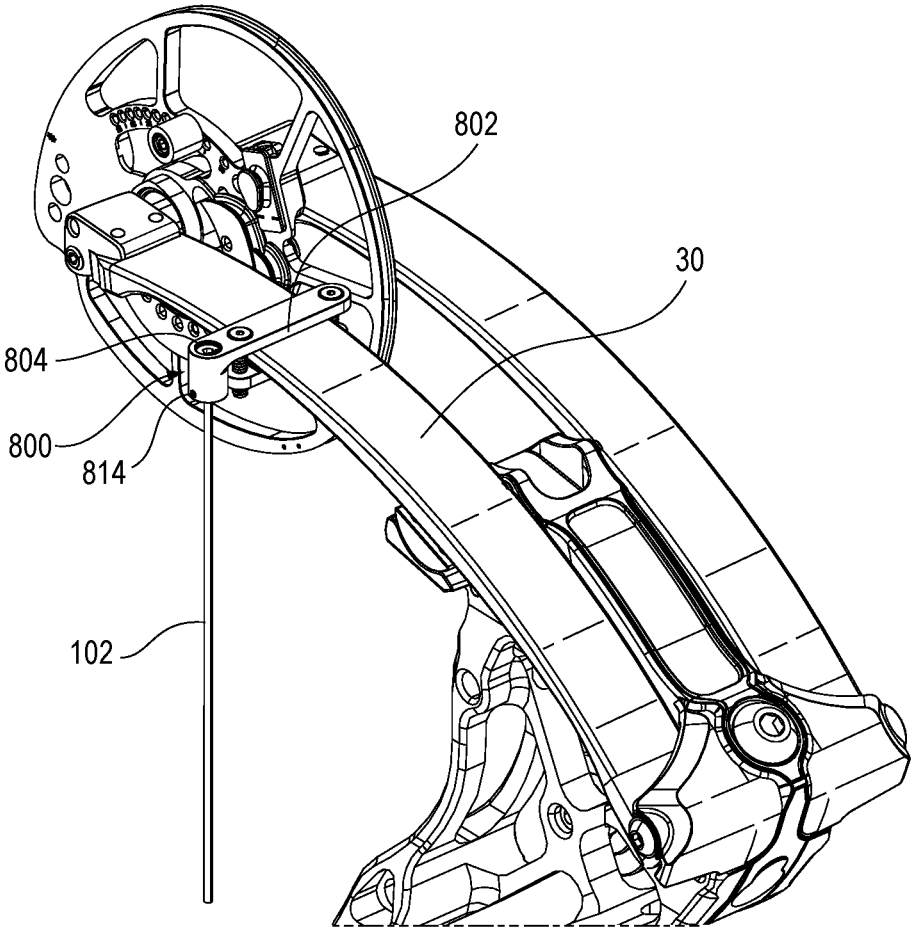
FIG. 22 is a perspective view of the tension adjusting device of FIG. 21 mounted on a bow limb.
Figure 23:
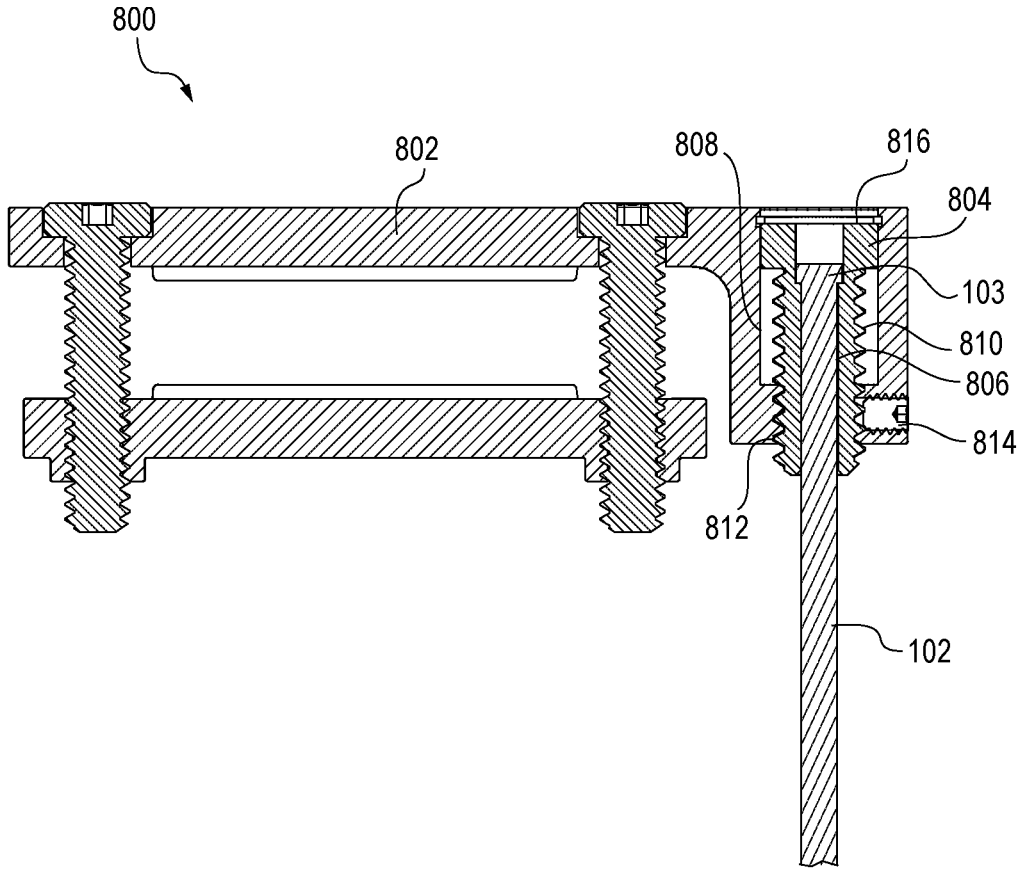
FIG. 23 is a sectional view of the tension adjusting device of FIG. 21.

FIGS. 21-23 illustrate another system for adjusting the effective length and tension in a rest cord 102 for an arrow rest 100. FIG. 21 illustrates a tension adjusting device 800. As shown, the tension adjusting device 800 may be include a body 802 that can be clamped or screwed to a limb 30 of a bow 10 as illustrated in FIG. 22. The tension adjusting device 800 may include a cord retainer 804 for holding an end of the rest cord 102. As best shown in FIG. 23, the cord retainer 804 may include a hole 806, such as through hole or a blind hole, for receiving and retaining an end of the rest cord 102. The hole 806 may include a first portion with a diameter that roughly corresponds to the diameter of the rest cord 102 and a second portion with a diameter that is larger and can receive a widened or flanged end 103 of the rest cord 102. The flanged end 103 can anchor or retain the rest cord 102 within the cord retainer 804 due to the flanged end 103 being too large to pass through the first portion of the hole 806 with the smaller diameter. In other embodiments, the cord retainer can hold the rest cord 102 by other means such as crimping or set screw engagement.

The cord retainer 804 may be adjustable within a hole or aperture 808 of the tension adjusting device 800 such that the effective length of cord 102 between the arrow rest 100 and the tension adjusting device 800 can be similarly adjusted. For example, the cord retainer 804 may have threads 810 on its outer surface that may be received within a threaded portion 812 of aperture 808 such that the cord retainer 804 can be rotated to change the linear position of the cord retainer 804. The cord retainer may include a hex head or other similar fastener head such that a user can rotate the cord retainer using a hex key or other similar tool. The hole 806 of the cord retainer 804 may rotate freely about the cord 102 without clamping or holding onto the cord 102 and transferring the rotation to the cord 102 so as to avoid twisting the cord 102. The tension adjusting device 800 may include a locking set screw 814 that can be tightened and hold the cord retainer 804 in a fixed position so that the cord retainer 804 is not inadvertently adjusted once the proper tension is set.

The aperture 808 may also include stops that prevent the cord retainer 804 from being adjusted too far in either direction and possibly falling out of the device 800. For example, the cord retainer 804 may be a screw-type member with an enlarged head compared to the rest of its body. The non-threaded portion of the aperture 808 may have a diameter that approximately corresponds to the enlarged head of the cord retainer 804 and the threaded portion 812 may have a smaller diameter such that the enlarged head interferes with the cord retainer 804 passing through the threaded portion 812. A retainer clip 816 may be included on an opposite end, such as by snapping the retainer clip 816 into a slot of the aperture 808, such that the retainer clip 816 interferes with the enlarged head backing out in the other direction. The retainer clip 816 may include an opening such that the cord retainer 804 can still be accessed and adjusted.

A user could adjust the effective length of the rest cord 102 a known distance by knowing the pitch of the threads 810. For example, the pitch of the threads 810 may be approximately 0.1 inch, so one full turn of the cord retainer 804 would result in approximately 0.1 inch alteration in the effective length of the rest cord 102 (or 0.025 inch for a quarter turn or 0.05 inch for a half turn).

Figure 24:
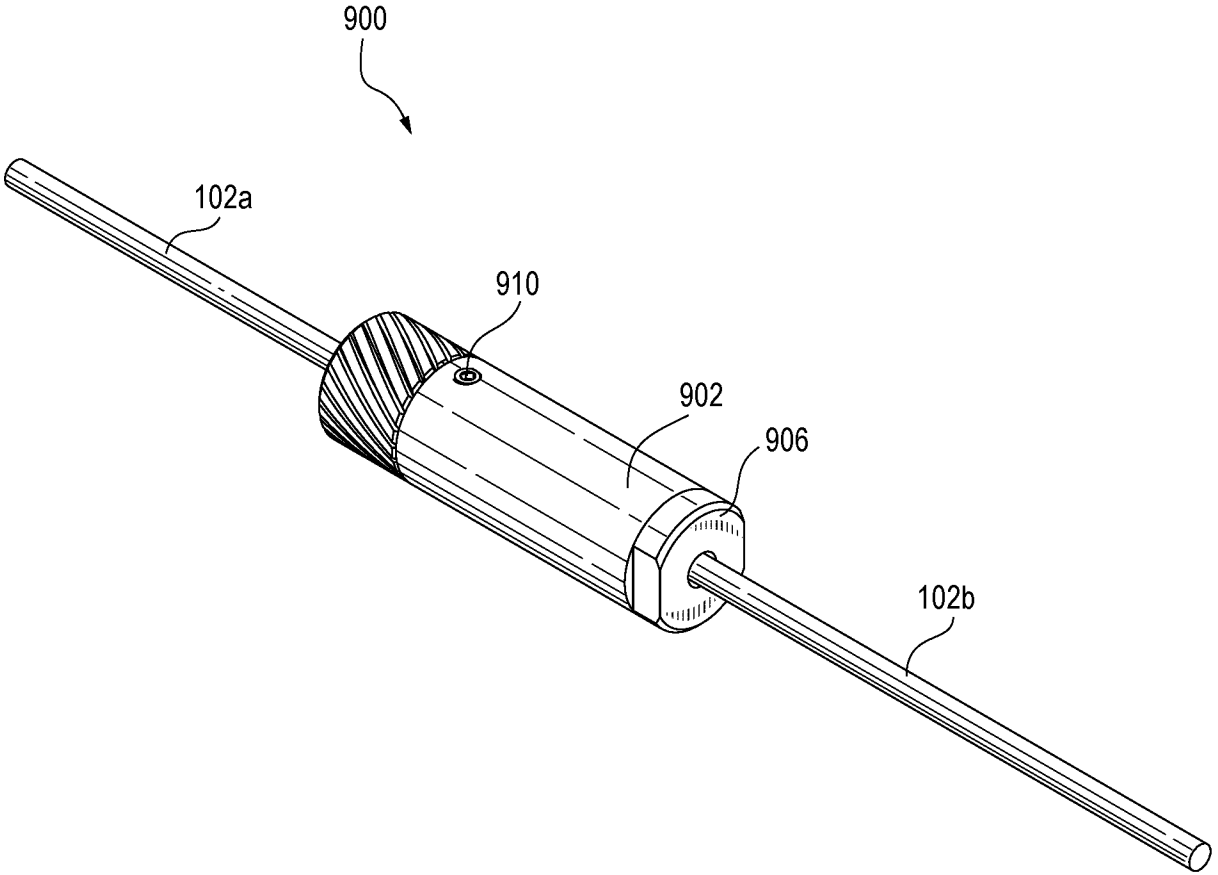
FIG. 24 is a perspective view of a tension adjusting device according to another embodiment.
Figure 25:
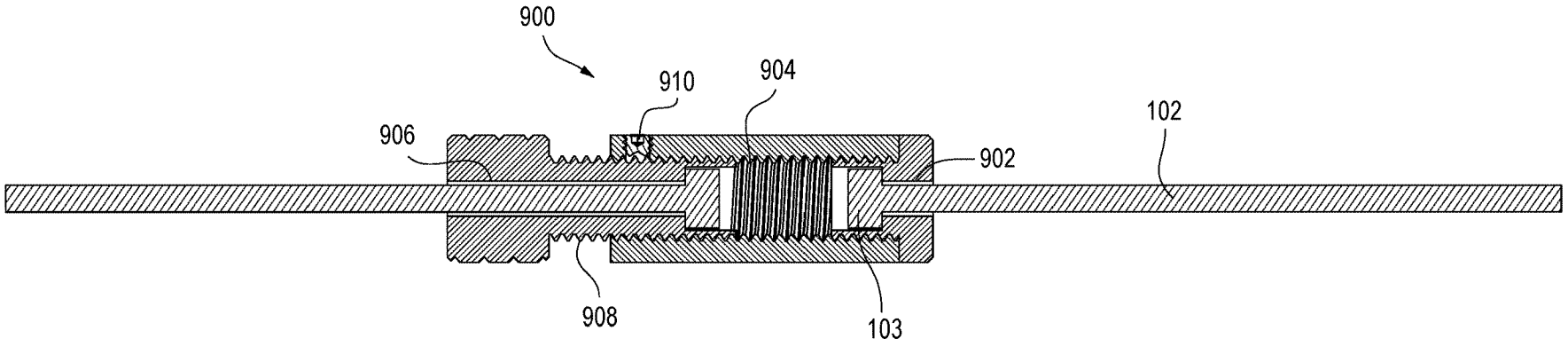
FIG. 25 is a sectional view of the tension adjusting device of FIG. 24.

FIGS. 24 and 25 illustrate another embodiment of a system for adjusting the effective length and tension in a rest cord 102. FIGS. 24 and 25 illustrate an in-line tension adjuster 900 having a first body 902 with a threaded aperture 904 and a second body 906 with corresponding external threads 908. The first body 902 may be fixedly coupled to a rest cord first portion 102*a* that can then couple to one of the arrow rest 100 or a fixed location on the bow 10. The second body 906 may be fixedly coupled to a rest cord second portion 102*b* that can then couple to the other of the arrow rest 100 or a fixed location on the bow 10. As shown in the illustrated embodiment, the rest cord 102 may be coupled to the first and second bodies 902, 906 using a flanged end 103 similar to as described above in reference to tension adjusting device 800. In other embodiments, the rest cord 102 may be coupled to the first and second bodies 902, 906 using other systems such as clamps, crimps, ferrules, set screws, adhesives, and the like.

The effective length of the rest cord 102 may then be determined by the effective length of the rest cord first and second portions 102*a*, 102*b* and the length of the in-line tension adjuster 900. The length of the in-line tension adjuster 900 may then be decreased or increased by rotating the second body 906 in the threaded aperture 904 of the first body 902 to extend or contract its total length and adjust the tension. Tension adjuster 900 may include a set screw 910 for engaging and locking the second body 906 in place relative to the first body 902 once a desired adjustment has been made.

Similar to as with the tension adjusting device 800, a user could adjust the effective length of the rest cord 102 a known distance according to the pitch of the threaded aperture 904. Further, the second body 906 may include a visual indicator (not shown), such as ruler markings, such that a user can see how far the second body 906 has moved into or out of the first body 902 to change the overall length.

From the accompanying materials, it will be seen that the invention is one well adapted to attain all the ends and objects set forth herein with other advantages which are obvious and which are inherent to the structure. It will be understood that certain features and subcombinations are of utility and may be employed without reference to other features and subcombinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described in the accompanying materials and illustrated in the drawings are presented by way of example only and are not intended to limit the concepts and principles of the present invention. Thus, there has been shown and described several embodiments of a novel invention. As is evident from the description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A fall away arrow rest system for use with a bow, the arrow rest comprising:

a housing adapted for mounting to a bow;

a rotatable shaft supported by the housing;

a launcher coupled to the rotatable shaft and configured to receive a shaft of an arrow;

a turn knob configured for receiving or coupling with a first end of a cord;

a gear coupled to the rotatable shaft and including gear teeth;

a pawl configured to engage with the gear teeth; and a biasing element that biases the pawl to engage the gear;

wherein rotating the turn knob in a first direction about an axis of rotation results in rotation of the turn knob about the rotatable shaft without transferring rotation to the rotatable shaft;

wherein rotating the turn knob in a second direction about the axis of rotation opposite the first direction results in the pawl engaging the gear teeth to transfer rotation of the turn knob to the rotatable shaft.

2. The arrow rest of claim 1, wherein the rotatable shaft is biased in the same direction of rotation as the first direction.

3. The arrow rest of claim 2, wherein the rotatable shaft is biased in a direction that corresponds to biasing the launcher to an upward position, wherein rotating the turn knob in the second direction rotates the launcher to a downward position.

4. The arrow rest of claim 2, wherein the rotatable shaft is biased in a direction that corresponds to biasing the launcher to a downward position, wherein rotating the turn knob in the second direction rotates the launcher to an upward position.

5. The arrow rest of claim 1, wherein the cord is coupled to a cable of the bow.

6. The arrow rest of claim 1, wherein the cord is coupled to a limb of the bow.

7. The arrow rest of claim 1, wherein the cord is configured such that tension in the cord can rotate the turn knob in the second direction.

8. The arrow rest of claim 7, wherein an amount of maximum tension in the cord when the bow is at draw or at brace can be adjusted by rotating the turn knob in the first direction.

9. The arrow rest of claim 1, further comprising a push button configured to engage the biasing element, wherein when the push button is depressed the biasing element does not bias the pawl to engage the gear.

10. A fall away arrow rest system for use with a bow, the arrow rest comprising:

a housing adapted for mounting to a bow;

a rotatable shaft supported by the housing;

a launcher coupled to the rotatable shaft and configured to receive a shaft of an arrow;

a turn knob configured for receiving or coupling with a first end of a cord;

a first element coupled to the rotatable shaft;

a second element configured to engage the first element; and a biasing element that biases the second element to engage the first element;

wherein rotating the turn knob in a first direction about an axis of rotation results in rotation of the turn knob about the rotatable shaft without transferring rotation to the rotatable shaft;

wherein rotating the turn knob in a second direction about the axis of rotation opposite the first direction results in the first element and second element interlocking to transfer rotation of the turn knob to the rotatable shaft.

11. The arrow rest of claim 10, wherein the first element and second element are permitted to skip or slide by each other when the turn knob is rotated in the first direction.

12. The arrow rest of claim 10, wherein the turn knob includes a set screw configured to engage the rotatable shaft and interlock the rotation of the turn knob and the rotatable shaft when tightened.

13. The arrow rest of claim 10, wherein the turn knob includes a set screw configured to engage and fixedly retain the first end of the cord within an aperture defined in the turn knob when the set screw is tightened.

14. The arrow rest of claim 10, wherein the rotatable shaft is biased in the same direction of rotation as the first direction.

15. The arrow rest of claim 14, wherein the rotatable shaft is biased in a direction that corresponds to biasing the launcher to a downward position, wherein rotating the turn knob in the second direction rotates the launcher to an upward position.

16. The arrow rest of claim 10, wherein the cord is configured such that tension in the cord can rotate the turn knob in the second direction.

17. A fall away arrow rest system for use with a bow, the arrow rest comprising:

a housing adapted for mounting to a bow;

a rotatable shaft supported by the housing;

a launcher coupled to the rotatable shaft and configured to receive a shaft of an arrow;

a turn knob configured for receiving or coupling with a first end of a cord;

a gear coupled to the rotatable shaft;

a detent ball biased by a biasing element to engage the gear; and a set screw threaded through the turn knob and configured to engage the rotatable shaft when tightened;

wherein rotating the turn knob about the axis of rotation without the set screw tightened results in rotation of the turn knob about the rotatable shaft without transferring rotation to the rotatable shaft;

wherein rotating the turn knob about the axis of rotation with the set screw tightened results in rotation of the turn knob transferring rotation to the rotatable shaft;

wherein the detent ball and biasing element are configured to bias the turn knob to one of a number of rotational positions that corresponds to the detent ball residing in a concave profile between adjacent teeth of the gear.

18. The arrow rest of claim 17, wherein the set screw is a first set screw, and wherein the turn knob includes a second set screw configured to engage and fixedly retain the first end of the cord within an aperture defined in the turn knob when the second set screw is tightened.

19. The arrow rest of claim 18, wherein a second end of the cord is fixed to the bow, wherein an amount of maximum tension in the cord when the bow is at draw or at brace can be increased by rotating the turn knob in a first direction about the axis of rotation, and wherein the amount of maximum tension in the cord can be decreased by rotating the turn knob in a second direction about the axis of rotation.

* * * * *